US006241621B1

(12) United States Patent
Maher

(10) Patent No.: US 6,241,621 B1
(45) Date of Patent: Jun. 5, 2001

(54) GOLF PRACTICE KIT AND METHOD FOR USING THE SAME

(76) Inventor: Timothy M. Maher, 168 Apple Blossom Dr., Branden, MS (US) 39042

( * ) Notice: Subject to any disclaimer, the term of this patent is extended or adjusted under 35 U.S.C. 154(b) by 0 days.

(21) Appl. No.: 09/148,796

(22) Filed: Sep. 4, 1998

(51) Int. Cl.[7] ..... A63B 69/36

(52) U.S. Cl. ..... 473/185; 473/180; 473/162; 473/196

(58) Field of Search ..... 473/162, 173, 473/174, 181, 185, 146

(56) References Cited

U.S. PATENT DOCUMENTS

| | | | | |
|---|---|---|---|---|
| 1,338,963 | | 5/1920 | Rolfe . | |
| 1,979,584 | * | 11/1934 | Thompson | 473/185 |
| 2,677,547 | | 5/1954 | Campbell . | |
| 3,490,769 | * | 1/1970 | Torbett | 473/196 |
| 3,752,482 | | 8/1973 | Cassel . | |
| 3,909,006 | * | 9/1975 | Arbaugh | 473/185 |
| 4,017,084 | | 4/1977 | Jeffery . | |
| 4,171,134 | | 10/1979 | Reck . | |
| 4,572,512 | | 2/1986 | Tegart . | |
| 4,906,006 | * | 3/1990 | Sigunick | 473/185 |
| 4,988,106 | * | 1/1991 | Coonrod | 473/162 |
| 5,401,027 | | 3/1995 | Surbeck . | |
| 5,435,560 | | 7/1995 | Kehoe . | |
| 5,779,567 | * | 7/1998 | Durso | 473/409 |
| 5,830,076 | * | 11/1998 | Borys | 473/173 |

FOREIGN PATENT DOCUMENTS

| | | | | |
|---|---|---|---|---|
| 490717 | * | 2/1953 | (CA) | 273/181 R |

OTHER PUBLICATIONS

"Toys & Tools", *Golf for Women,* Sep.–Oct., 1996, pp. 81–84 and "Classifields" page.

* cited by examiner

*Primary Examiner*—Mark S. Graham
(74) *Attorney, Agent, or Firm*—Roylance, Abrams, Berdo & Goodman, L.L.P.

(57) ABSTRACT

A kit for use in practicing golf, comprising a putting target set, a lag putting target set, a chipping target set, and a general iron play target set. Each of the targets has a first substantially planar surface and a second highly visible, substantially planar surface opposite and substantially parallel to the first substantially plainer surface. The first substantially planar surface has a first surface area adapted to rest on a supporting surface, such as the ground, and the second substantially planar surface has a second surface area sufficient to carry at least a portion of a golf ball thereon when the first substantially planar surface rest on the supporting surface. Each of the targets is made of a material adapted to substantially conform to the supporting surface when the first surface rests on the supporting surface. Also, the overall sizes of targets in each of the sets are preferably different from each other. At least some of the targets include a plurality of eyelets having a size sufficient to receive a golf tee or golf ball marker to secure the targets to the ground. The targets in the lag putting kit also include substantially C-shaped cuts at their respective/centers, which form flap portions that can be received in a standard golf hole. One of the targets in the general iron play set may include a drawstring which enables that target to function as a carry sack to carry the remainder of the targets.

42 Claims, 8 Drawing Sheets

GOLF PRACTICE KIT AND METHOD FOR USING THE SAME

BACKGROUND OF THE INVENTION

1. Field of the Invention

The present invention relates to a golf practice kit and method for using the same. More particularly, the present invention relates to a golf practice kit including a plurality of differently sized, flexible targets, which can be placed in various combinations and at different positions with respect to each other to enable a golfer to practice putting, lag putting, chipping, and general iron play.

2. Description of the Related Art

Many different types of golf practice equipment are available to assist golfers in improving their game. For example, automatic ball return devices which enable a golfer to practice putting on, for example, the carpet of his or her living room or office have been in use for many years. Practice ranges having markers visible at different yardages for golfers to practice their general iron play skills are also widespread.

Other types of golf practice kits have developed over the years. For instance, U.S. Pat. No. 1,338,963 describes a golf game including an elongated strip of canvas having a bullseye-shaped target at one end, and distance markings from the target at locations along the canvas. A golfer can practice his or her putting ability by aiming for the bullseye target at different distances along the canvas.

U.S. Pat, No. 2,677,547 to Campbell describes a golf practice game which includes a chipping mat having a tee, and a separate octagon-shaped target that can be placed at a desired distance from the mat. The target includes eight straight sections which are each formed of a sheet material, such as cardboard or the like, and are connected together at their ends by tape strips to create the octagon shape. Accordingly, the target can be folded into a compact stack of the eight strips when not in use.

U.S. Pat. No. 4,017,084 to Jeffery describes a golf practice apparatus including a receptacle device, which has a recess for receiving golf balls and a storage compartment for storing a roll of carpet. The roll of carpet has a sequence of distance markings on its upper surface, and can be unrolled from the storage compartment so that its distal end extends at a desired distance from the receptacle. A golfer can then practice chipping golf balls at desired distances along the carpet into the receptacle. Furthermore, the Jeffrey golf practice apparatus includes a flag accessory device which comprises a plurality of concentric strips connected about a common central point at which a flag is secured. The golfer can practice chipping golf balls into the concentric strips encircling the base of the flag.

Another type of circular-shaped putting or chipping target is described in U.S. Pat. No. No. 5,435,560 to Kehoe. The Kehoe target is a single, flexible disk-shaped target having a smaller diameter circle pattern at its center, which simulates a standard golf hole, and an aiming target positioned between the outer periphery of the circular pattern and the outer periphery of the disk. The kit further includes a strip of material that is placed at an appropriate distance behind the disk to act as a distance marker indicating the maximum distance that a putted or chipped golf ball should travel past the circular disk when a golfer is using the disk as a target for practicing chipping or putting.

Other types of kits which are capable of creating circular or substantially circular-shaped targets for practicing chipping are described in U.S. Pat. No. 4,171,134 to Reck and U.S. Pat. No. 5,401,027 to Surbeck. Each of these patents discloses the use of a flexible tubing to form shaped patterns of different diameters about a target point. A golfer can practice chipping golf balls into the different diameter patterns. However, these practice kits are generally impractical for putting practice, because the tubing will deflect a ball being putted for a central target point, thus making it impossible for the golfer to judge the accuracy of his or her putting. Furthermore, these tubular structures cannot generally be made into small enough circular patterns to enable a golfer to practice short putting. Additionally, because the tubes have a small diameter, the circular patterns formed by the tubes are difficult to see at far distances (e.g., at distances of over 150 yards).

Accordingly, a continuing need exist for a golf practice kit which enables a golfer to practice short putting, lag putting, chipping and general iron play, and which provides targets which are easily compactable, and highly visible at the distances at which they are intended for use.

SUMMARY OF THE INVENTION

An object of the present invention is to provide a golf practice kit which allows for practicing of putting, lag putting, chipping and general iron play.

Another object of the present invention is to provide a golf practice kit comprising a plurality of highly visible targets which are easily viewed from a distance at which they are intended to be used.

A further object of the invention is to provide a golf practice kit comprising a plurality of differently-sized targets that are easily compactable for storage and transportation, and which are readily conformable to the shape of the surface on which they are placed.

Another object of the present invention is to provide a golf practice kit comprising a plurality of targets wherein one of the targets functions as a carry sack for the remainder of the targets and/or practice golf balls.

A still further object of the present invention is to provide a golf practice kit comprising a plurality of differently-sized targets which are easily attached to the ground to remain stationery during use.

These and other objects of the present invention are substantially achieved by a kit for use in practicing golf comprising a plurality of targets, each comprising a first substantially planar surface and a second substantially planar surface opposite and substantially parallel to the first substantially planar. The first substantially planar surface has a first surface area adapted to rest on a supporting surface, such as the ground, and the second substantially planar surface has a second surface area sufficient to carry at least a portion of a golf ball thereon when the first substantially planar surface rest on the supporting surface. Each of the targets are made of a material adapted to substantially conform to the supporting surface when their first surface area rests on the supporting surface. Also, the overall size of at least one of the targets is different from the size of another of the targets, and, preferably, each of the targets has a different size.

The second surface areas are highly visible at the distances at which their respective targets are intended to be used. Also, some of the targets include a plurality of slits or eyelet openings having a size sufficient to receive a golf tee or golf ball marker to secure the targets to ground. Some of the targets also include a substantially C-shaped cut at their respective centers, which forms a flap portion that can be received into a standard golf hole. Furthermore, one of the targets includes a drawstring which enables that target to function as a carry sack to carry the remainder of the targets and/or practice golf balls.

BRIEF DESCRIPTION OF THE DRAWINGS

The various objects, advantages and novel features of the present invention will be more readily appreciated from the following detailed description when read in conjunction with the accompanying drawings, in which.

DETAILED DESCRIPTION OF THE PREFERRED EMBODIMENTS

Figure 1:
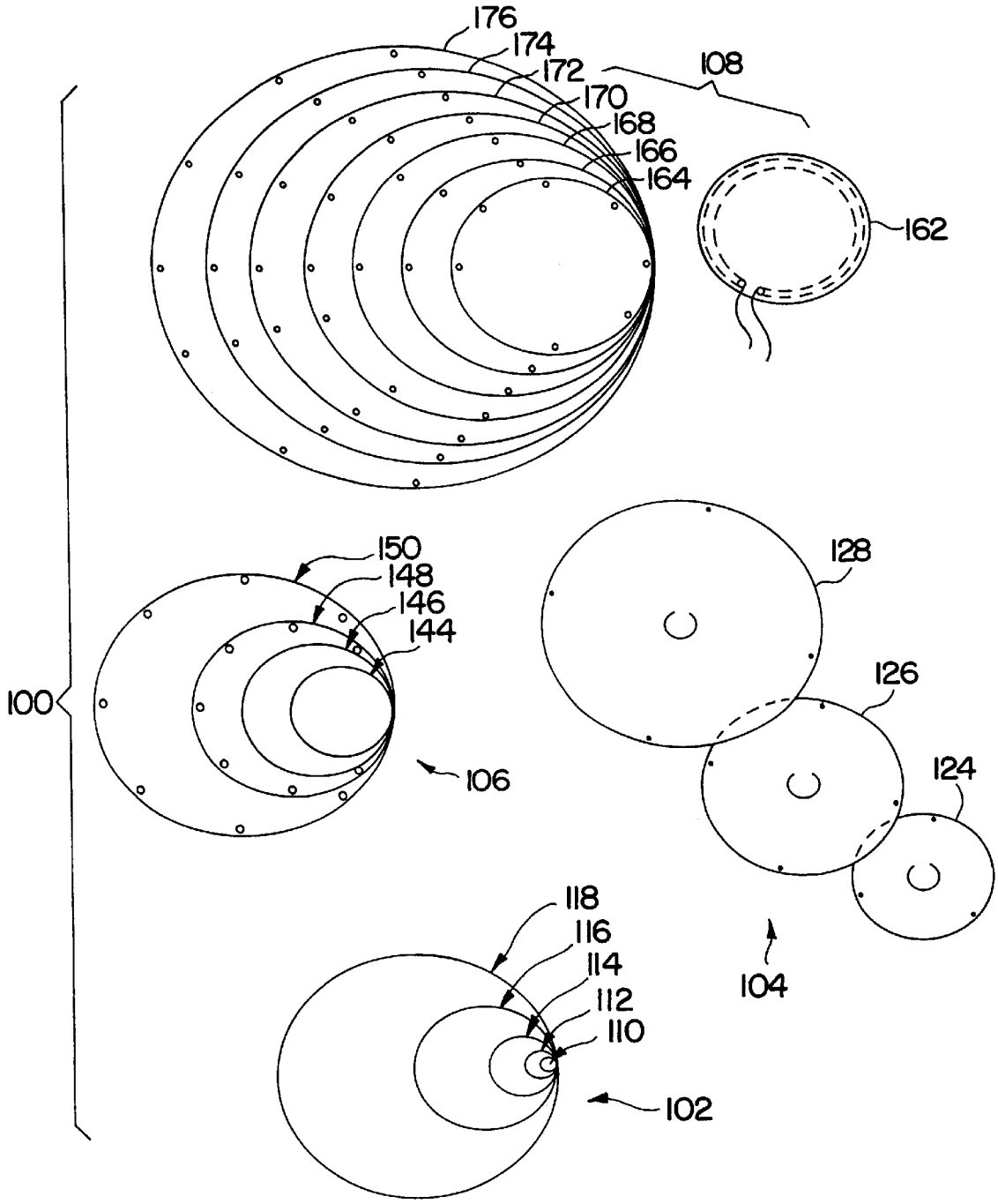
FIG. 1 is a schematic view of a golf practice kit according to an embodiment of the present invention.

A golf practice kit 100 according to an embodiment of the present invention is shown schematically in FIG. 1. In particular, golf practice kit 100 include a plurality of target sets, namely, a putting target set 102, a lag putting target set 104, a chipping target set 106 and a general iron play target set 108. The plurality of targets are illustrated schematically on top of each other to depict the differences in their diameters. However, the sizes of the targets shown in FIG. 1 are for exemplary purposes, and are not to scale.

Figure 2:
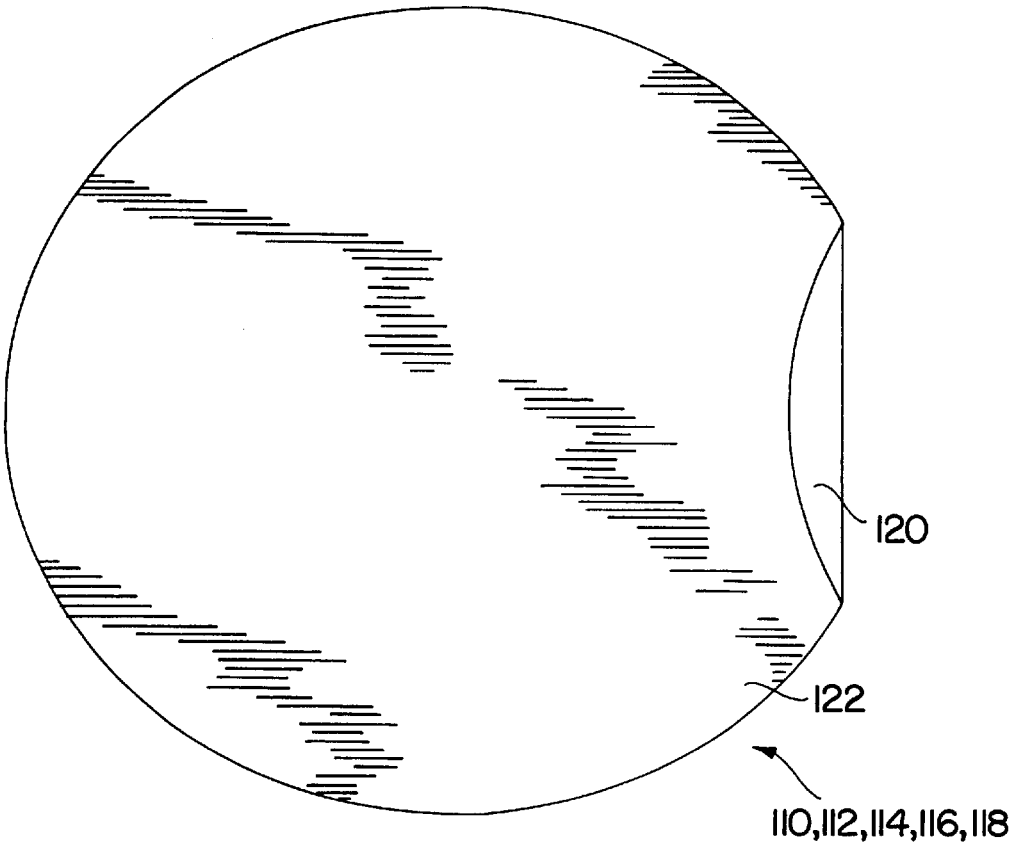
FIG. 2 is a plan view of an example of a target included in the golf practice kit shown in FIG. 1.

Putting target set 102 includes a first putting target 110, second putting target 112, third putting target 114, fourth putting target 116 and fifth putting target 118. An example of the shape and construction of fist through fifth putting targets 110–118 is shown in FIG. 2. Each of first through fourth putting targets 110–116 is made, for example, of a plastic material, such as soft or hard plastic, and putting target 118 is made of a more flexible material such as a synthetic, flexible plastic tarp-grade material, soft plastic, woven material or any other material which is flexible and readily conformable to a surface on which the targets are set Each of first through fifth putting targets 110–118 has a first planar or substantially planar surface 120, and a second planar or substantially planar surface 122 on the opposite side of first surface 120. First surface 120 is adaptable for placement on a supporting surface, such as ground, a floor, a carpet, or the like. Second surface 122 is therefore exposed when first surface 120 is placed on the supporting surface.

Typically, at least the second surface 122 will have a color that is highly visible at a distance at which the target is to be used. For instance, the second surface 122 can be yellow, blue, red, white or any suitable color that is readily distinguishable from the supporting surface, and can have a flat, glossy or fluorescent finish. Preferably, since the first through fifth putting targets 110–118 generally are used on a putting green or on an area of low-cut grass covered ground, it is desirable that the surface which is to remain exposed (in this example, the second surface 122) has a color other than green so it is readily distinguishable from the surrounding grass. Also, the entire target, including both the first and second surfaces 120 and 122, can be of the same color. Furthermore, the first through fifth putting targets 110–118 can be the same color, or can each be different colors or have any combination of colors, such as those set forth in the color scheme described below for the golf practice kit 100.

As shown schematically in FIG. 1, first putting target 110 is circular or substantially circular in shape and has the smallest diameter of all the putting targets In this example, first putting target 110 has a diameter of about 0.5 inches and thus, surfaces 120 and 122 of first putting target 110 each occupy an area of about 0.2 square inches. The second putting target 112 has a diameter of about 1.0 inches, and therefore, surfaces 120 and 122 of second putting target 112 each occupy an area of about 0.8 square inches.

The third putting target 114 is the next largest target, and has a diameter of about 2.0 inches, with its first and second surfaces each occupying an area of about 3.1 square inches. The fourth putting target has a diameter of about 4.25 inches, which is at or about the diameter of a regulation golf hole. The first and second surfaces of the fourth putting target 116 each occupy an area of about 14.2 square inches. Fifth putting target 118 is the largest putting target, and has a diameter of about 8.5 inches. First and second surfaces of fifth putting target of 118 therefore each occupy an area of about 56.7 square inches.

Accordingly, in this example, the first putting target 110 has a diameter of about ⅛ the diameter of a regulation golf hole, second putting target 112 has a diameter of about ¼ the diameter of a regulation golf hole, third putting target 114 has a diameter of about ½ that of a regulation golf hole, fourth putting target 116 has a diameter equal or about equal to that of a regulation golf hole, and fifth putting target 118 has a diameter of about twice that of a regulation golf hole. However, putting targets set 102 can include different or additional putting targets having different diameters than those set forth above. Furthermore, the first through fifth putting targets 110–118 need not be circular in shape, but can be oval, square, polygonal or any other suitable shape which will achieve the purpose described below.

Lag putting target set 104 in this example includes a first lag putting target 124, a second lag putting target 126, and a third lag putting target 128. The first through third lag putting targets 124–128 each are made of a flexible material such as those described above for putting target 118, or any suitable material which is conformable with a surface on which the lag putting target is to be placed An example of one of the first through third lag putting targets 124–128 is shown in perspective view in FIG. 3. As with putting targets 110–118, first through third lag putting targets 124–128 each are circular or substantially circular in shape, and include a first planar or substantially planar surface 130 and a second planar or substantially planar surface 132. The first surface 130 is adaptable for placement on a supporting surface, such as ground or the like, while second surface 132 remains exposed. The first through third lag putting targets 124–128 each have a color which makes them highly visible at the distances at which they are intended to be used. For example, the first through third lag putting targets 124–128 each can be yellow, blue, white, red or any other suitable color having a flat, glossy or fluorescent finish. Most importantly, the surface which is to remain exposed (in this example, the second surface 132) should have the highly visible color, although the entire target could be colored. Also, targets 124–128 can each have different colors, such as those in accordance with the color scheme described below.

First through third lag putting targets 124–128 each include a C-shaped or substantially C-shaped cut 134 at or approximate at their center. The C-shaped cut 134 forms a flap portion 136 at or proximate to the center of the lag putting targets 124–128. As described in more detail below, the flap portion 136 has a size small enough to fit into a regulation size golf hole. In this example, the C-shaped cut 134 has a maximum diameter of about 4 inches, and the flap portion 136 therefore has a maximum diameter portion of about 4 inches.

Figure 3:
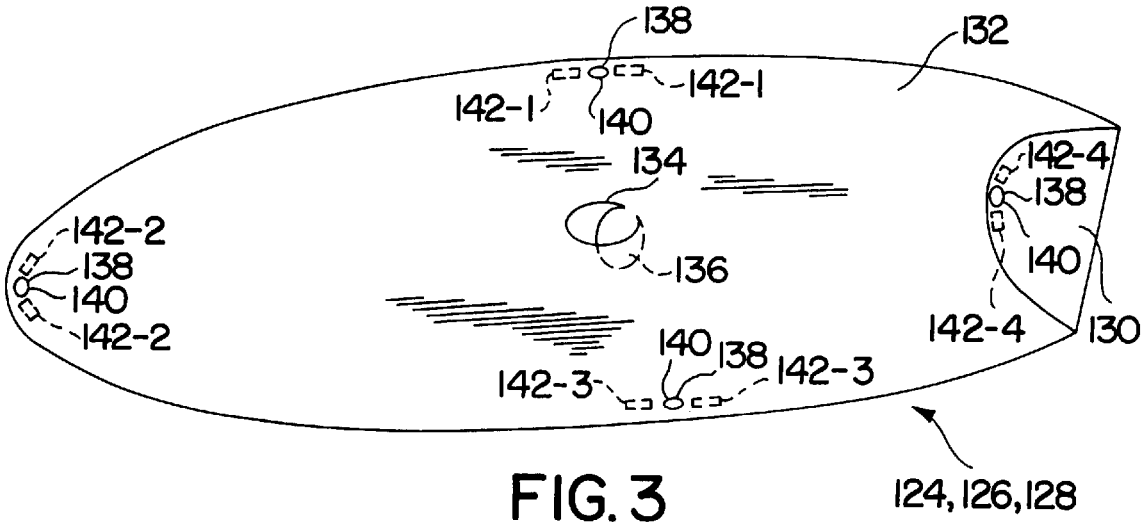
FIG. 3 is a perspective view of an example of another type of target included in the golf practice kit shown in FIG. 1.

As further shown in FIG. 3 in particular, first through third lag putting targets 124–128 each include a plurality of opening 138, such as circular openings, slits, and so on, spaced at locations about their parameters. As described in more detail below, the openings each have a size sufficient to receive the shaft of a golf tee or the shaft of a golf ball marker to secure the lag putting target to ground or any other suitable supporting surface. An eyelet 140, made of metal, plastic, or any other suitable material, can be fitted into each of the openings 138 to provide added support at the openings 138 to prevent tearing of the lag putting target. In the example shown in FIG. 3, the lag putting target includes four openings 138, each spaced at 90° about the parameter of the lag putting target However, the lag putting target can include less or more openings 138 as deemed necessary.

As further shown in phantom in FIG. 3, lag putting targets 124–128 optionally can each include fastening members 142-1 through 142-4 which are mounted proximate to openings 138 on the first surface 130, second surface 132, or both. The fastening members 142-1 through 142-4 can be any suitable type of arrangement which can mate with another one of the fastening members to enable the lag putting target to be folded onto itself. For example, the fastening members 142-1 through 142-4 can be Velcro tabs that are adhered to the surfaces 130 and/or 132 of the lag putting targets (e.g., sewn on or held by adhesive) and couple with each other so that the lag putting target can be folded onto itself and held together by the engagement of the Velcro fastening members 142-1 through 142-4.

For instance, fastening members 142-1 and 142-2 on surface 132 can be loop-type Velcro tabs, and fastening members 142-3, along with the fastening members (not shown) which are on surface 132 proximate to the other opening 138 (e.g., reverse of fastening members 142-4 which are shown on surface 130), can each be a hook-type Velcro tab. Also, the fastening members (not shown) on surface 130 at locations reverse to fastening members 142-1 and 142-2 can be hook-type Velcro tabs, and the fastening members (not shown) on surface 130 at locations reverse to fastening members 142-3, as well as fastening members 142-4, can be loop-type Velcro tabs. The hook-type Velcro tabs can be mated with the loop-type Velcro tabs to hold the lag putting target folded onto itself, so that the lag putting target can therefore be easily stored as will be described in more detail below.

As shown in FIG. 1, first lag putting target 124 has the smallest diameter, and third lag putting target 128 has the largest diameter. In this example, first lag putting target has a diameter of about 17.0 inches. The first and second surface areas 130 and 132 of first lag putting target 124 therefore each occupy an area of about 1.58 square feet.

Second lag putting target 126 has a diameter of about 25.5 inches. Accordingly, the first and second surfaces of second lag putting target 126 each occupy an area of about 3.54 square feet. Third lag putting target 128 has a diameter of about 34.0 inches. The first and second surfaces 130 and 132 of third lag putting target 128 therefore each occupy an area of about 6.3 square feet.

Although first through third lag putting targets 124–128 are shown as being circular, they can be any suitable shape, such as oval, square, polygonal, or any other shape which will enable them to perform their intent and function as described below. Also lag putting target set 104 can include additional lag putting targets, or lag putting targets having sizes other than those mentioned.

As further shown in FIG. 1, chipping target set 106 includes a first chipping target 144, second chipping target 146, third chipping target 148 and fourth chipping target 150. First through fourth chipping targets 144–150 each are made of a flexible material, such as those described above for lag putting targets 124–168 and putting target 118, or any other suitable material that is conformable to the surface on which they are to be placed.

Figure 4:
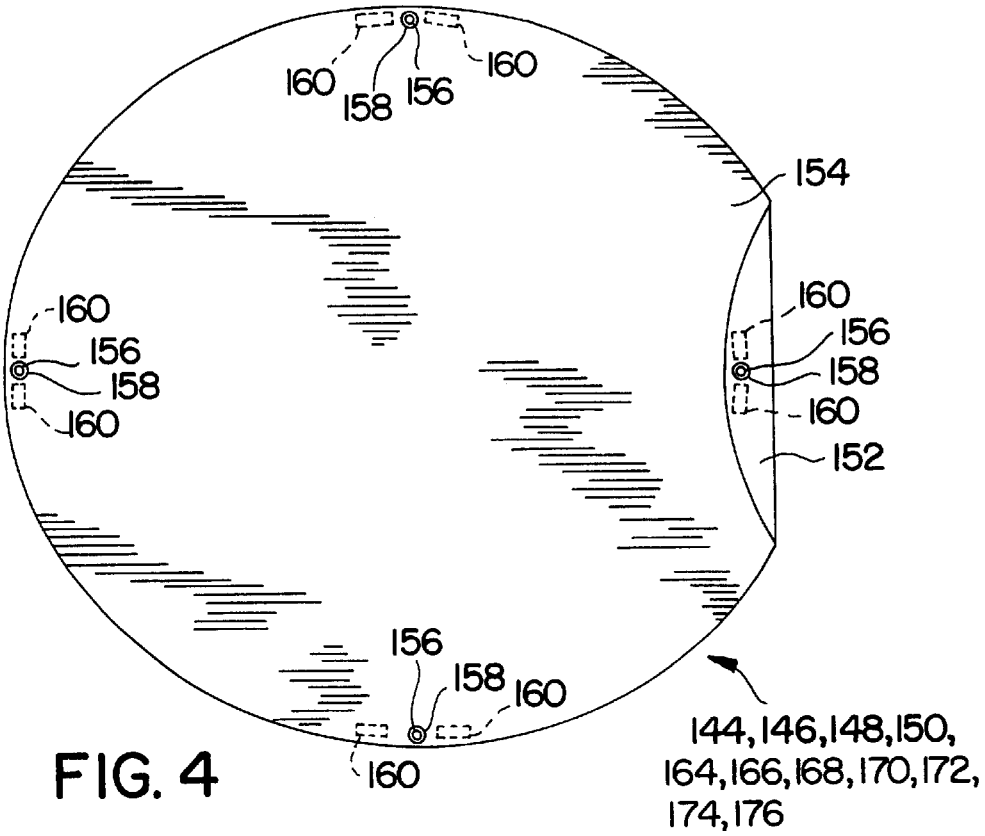
FIG. 4 is a plan view of an example of another type of target included in the golf practice kit shown in FIG. 1.

An example of any of the first through fourth chipping targets 144–150 is shown in FIG. 4. In particular, as with putting targets 110–118 and lag putting targets 124–128, first through fourth chipping targets 144–150 each include a first planar or substantially planar surface 152, adaptable for placement on a supporting surface such as grass covered ground or any other suitable surface, and a second planar or substantially planar surface 154 which remains exposed when the fit surface 152 is placed on the supporting surface.

The first through fourth chipping targets 144–150 each have a color that is highly visible at the distance at which they are intended to be used. For example, chipping targets 144–150 can be yellow, blue, red, white or any other suitable color distinguishable from the supporting surface, which generally is grass covered ground, and could have a flat, glossy or fluorescent finish. Preferably, first through fourth chipping targets 144–150 have a color other than green. Also, although the entirety of the target could be colored, only the surface remaining exposed (in this example, the second surface 154) of the chipping targets 144–150 need be colored with the highly visible color. Also, the targets 144–150 could have multiple colors, and have colors different from each other, such as those in accordance with the color scheme described below.

As further shown in FIG. 4, each of the first through fourth chipping targets 144–150 can include a plurality of openings 156 about its parameter which are similar to openings 138 described above. Eyelets 158, similar to eyelets 140 described above, can be fit into openings 156 to provide added support Also, fastening members 160, which are shown in phantom and similar to fastening members 142 described above, can optionally be mounted to the first surface 152, second surface 154, or both proximate to openings 156 as shown.

As shown in FIG. 1, first chipping target 144 is the smallest chipping target, and fourth chipping target 150 is the largest chipping target. Although the first through fourth chipping targets 144–150 are shown as being circular or substantially circular in shape, chipping targets 144–150 can be oval, square, polygonal, or have any other shape suitable to achieve their purpose described below.

In this example, first chipping target 144 has a diameter of about 1.0 feet, and thus, its first and second surfaces each occupy an area of about 0.79 square feet. Second chipping target 146 has a diameter of about 1.5 feet and thus, its first and second surfaces each occupy an area of about 1.77 square feet. A third chipping target 148 has a diameter of about 2.0 feet, with its first and second surfaces each occupying an area of about 3.14 square feet. Fourth chipping target 150 has a diameter of about 3.0 feet, with its first and surfaces each occupying an area of about 7.07 square feet Although the chipping target set 106 is shown as including four chipping targets, chipping target set 106 can include additional chipping targets having larger or smaller diameters, or chipping targets of sizes different than those set forth above.

As further shown in FIG. 1, general iron play target set 108 includes a first general iron play target 162, a second general iron play target 164, a third general iron play target 166, a fourth general iron play target 168, a fifth general iron play target 170, a sixth general iron play target 172, a seventh general iron play target 174 and a eighth general iron play target 176. Each of first through eighth general iron play targets 162–176 are made of a flexible material, such as those described above for chipping targets 144–150, lag putting targets 124–126, and putting target 118, or any other suitable material that is substantially conformable to the supporting surface, such as grass covered ground or any other suitable surface, on which the target is to be placed.

In this example, second through eighth general iron play targets 164–176 each can have an overall configuration similar to that shown in FIG. 4. That is, each of second through eighth general iron play targets 164–176 can include a first planar or substantially planar surface 152, and a second planar or substantially planar surface 154. The second through eighth general iron play targets 164–176 can include openings 156, eyelets 158 and optionally fastening members 160 as shown in FIG. 4 and described above with regard to the chipping targets.

Furthermore, the second through eighth general iron play targets 164–176 each have a color that is highly visible at the distances at which they are to be used. Hence, the second through eighth general iron play targets 164–176 can be yellow, blue, red, white or any other suitable color that is readily distinguishable from the color of the supporting surface, which is typically grass covered ground, and can have a flat, glossy or fluorescent finish. Also, only the surface remaining exposed (in this example, second surface 154) of the second through eighth general iron play targets 164–176 need be colored with the highly visible color. Furthermore, the first through eighth general iron play targets 162–176 can have the colors set forth in the color scheme described below.

Figure 5:
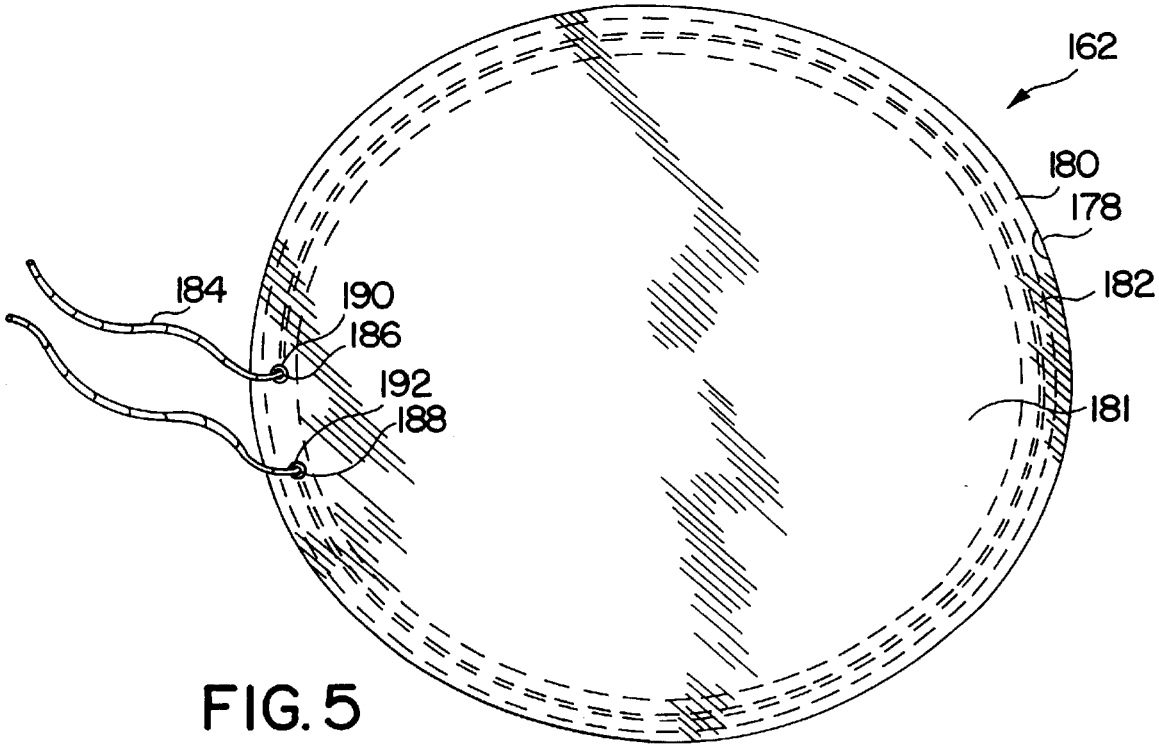
FIG. 5 is a plan view of target included in the golf practice kit shown in FIG. 1, which also functions as a carry sack for the other targets in the golf practice kit and/or practice golf balls.
Figure 6:
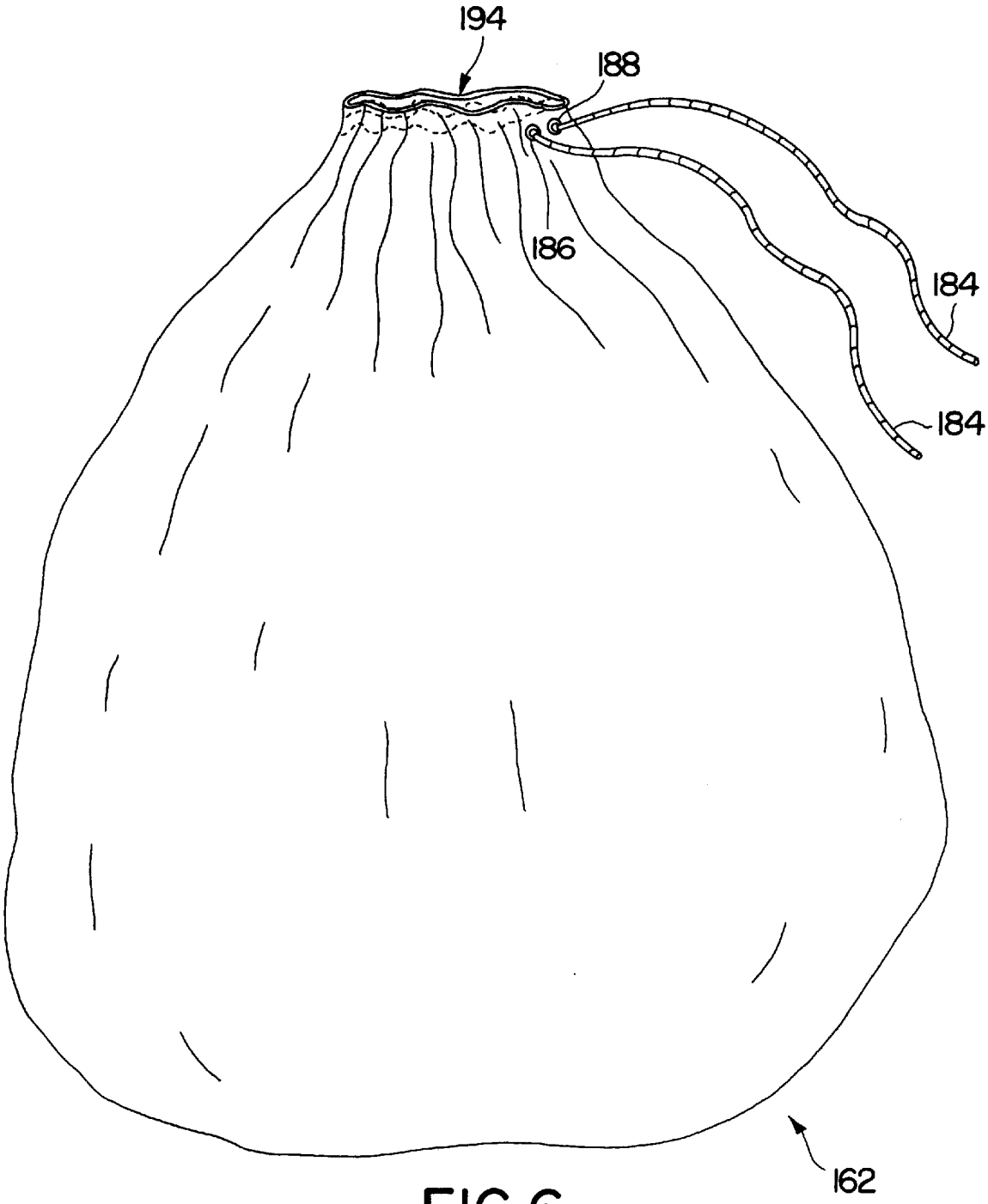
FIG. 6 is a perspective view of the target shown in FIG. 5 being arranged as a carry sack.

As shown in FIGS. 5 and 6, first general iron play target 162 which, as described in more detail below, is the smallest diameter target, is adaptable for use as a carry sack to carry some or all of the remaining general iron play targets 164–176, as well as the putting target set 102, lag putting target set 104, chipping target set 106, and practice golf balls. In particular, first general iron play target 162 includes a first planar or substantially planar material piece 178 having a first planar surface (not shown), adaptable for placement on a supporting surface such as ground, and a second planar or substantially planar material piece 180 having a second planar surface 181. The first and second material pieces 178 and 180 can each be made of a flexible material, such as those described above for the putting, lag putting, chipping and general iron play targets, or any other suitable material. The first and second material pieces each can have a highly visible color, such as those described above for the other general iron play targets 164–176. Most importantly, the surface remaining exposed (in this example, second surface 181) should have the highly visible color.

As illustrated, first and second pieces 178 and 180 are sewn together or connected by any other suitable method, such as by an adhesive or the like, to form an annular chamber 182 therein. A drawstring 184 passes through a first opening 186 in the second material piece 180, which communicates with annular chamber 182, through annular chamber 182, and out of second opening 188 in the second material piece 180. Eyelets 190 and 192, such as eyelets 140 and 158 described above, can be mounted in openings 186 and 188 to provide added support to prevent the drawstring 184 from tearing the second material piece 180.

Accordingly, as shown in FIG. 6, when the ends of drawstring 184 are pulled, the drawstring 184 gathers the perimeter of first general iron play target 162 together to shape the first general iron play target 162 into a sack-like configuration forming a receiving opening 194 therein. Up to all of the remaining general iron play targets 164–176, as well as the putting target set 102, lag putting target set 104, and chipping target set 106, can be rolled up or folded and stored in opening 194, along with practice balls, if desired. The first general iron play target 162 therefore acts as a carry sack for the entire golf practice set 100.

Returning to FIG. 1, as illustrated, first general iron play target 162 is the smallest diameter general iron play target, and eighth general iron play target 176 is the largest diameter general iron play target. Although the first general iron play target 162 is shown as being adaptable to form a carrying sack, any of the first through eighth general iron play targets 164–76, or any of the chipping or lag putting targets having a sufficient size, can be configured as the carry sack.

In this example, the first general iron play target 162 has a diameter of about 3.5 feet, and its first and second surfaces each occupy an area of about 9.62 square feet. The second general iron play target 164 has a diameter of about 4.0 feet, and therefore, its first and second surfaces each occupy an area of about 12.56 square feet. The third general iron play target 166 has a diameter of about 5.0 feet, and therefore, its first and second surfaces each occupy an area of about 19.63 square feet.

The fourth general iron play target 168 has a diameter of about 6.0 feet, and its first and second surfaces therefore each occupy an area of about 28.26 square feet. Fifth, sixth, seventh and eighth general iron play targets 170–176 have diameters of about 7.0 feet, 8.0 feet, 9.0 feet and 10.0 feet, respectively. Therefore, first and second surfaces of fifth general iron play target 170 each occupy an area of about 38.47 square feet, first and second surfaces of sixth general iron play target 172 each occupy an area of about 50.24 square feet, first and second surfaces of seventh general iron play target 174 each occupy an area of about 63.59 square feet, and first and second surfaces of eighth general iron play target 176 each occupy an area of about 78.50 square feet.

The exemplary sizes for each of the targets discussed above, along with exemplary recommended distances at which those targets could be used, are set forth in Table 1 below.

TABLE 1

EXEMPLARY TARGET SIZES AND DISTANCES FOR USE

| Target No. | Radius Inches | Diameter in Inches | SQ IN | SQ FT | Distance |
|---|---|---|---|---|---|
| Target sizes for putting | | | | | |
| 110 | 0.25 | 0.50 | 0.20 | | <3 Ft |
| 112 | 0.50 | 1.00 | 0.79 | 0.01 | 3 Ft to 6 Ft |
| 114 | 1.00 | 2.00 | 3.14 | 0.02 | 6 Ft to 9 Ft |
| 116 | 2.125 | 4.25 | 14.18 | 0.10 | 9 Ft to 12 Ft |
| 118 | 4.25 | 8.50 | 56.72 | 0.39 | 12 Ft to 15 Ft |
| Target sizes for lag putting | | | | | |
| 124 | 8.50 | 17.00 | 226.87 | 1.58 | 15 Ft to 25 Ft |
| 126 | 12.75 | 25.50 | 510.45 | 3.54 | 25 Ft to 35 Ft |
| 128 | 17.00 | 34.00 | 907.46 | 6.30 | >35 Ft |
| Target sizes for chipping and pitching | | | | | |
| 144 | 6 | 1.0 | 113.04 | 0.79 | 3 Yd to 6 Yd |
| 146 | 9 | 1.5 | 254.34 | 1.77 | 6 Yd to 9 Yd |
| 148 | 12 | 2.0 | 452.16 | 3.14 | 9 Yd to 12 Yd |
| 150 | 18 | 3.0 | 1017.36 | 7.07 | 12 Yd to 15 Yd |
| Target for wedges and short irons | | | | | |
| 162 | 21 | 3.5 | 1384.74 | 9.62 | 15 Yd to 30 Yd |
| 164 | 24 | 4.0 | 1808.64 | 12.56 | 30 Yd to 60 Yd |
| 166 | 30 | 5.0 | 2826.00 | 19.63 | 60 Yd to 90 Yd |
| 168 | 36 | 6.0 | 4069.44 | 28.26 | 90 Yd to 120 Yd |
| Target sizes for mid and long irons | | | | | |
| 170 | 42 | 7.0 | 5538.96 | 38.47 | 100 Yd to 125 Yd |
| 172 | 48 | 8.0 | 7234.56 | 50.24 | 125 Yd to 150 Yd |
| 174 | 54 | 9.0 | 9156.24 | 63.59 | 150 Yd to 175 Yd |
| 176 | 60 | 10.0 | 11304.00 | 78.50 | 175 Yd to 200 Yd |

The targets in the golf practice kit 100 also can have the following color scheme shown in Table 2, gets and lag putting targets being referred to generally as "putting targets".

TABLE 2

EXEMPLARY TARGET COLOR SCHEME

| Target | Color |
|---|---|
| Long Iron Target No. | |
| 176 | Yellow |
| 174 | Blue |
| 172 | White |
| 170 | Red |

TABLE 2-continued

EXEMPLARY TARGET COLOR SCHEME

| Target | Color |
|---|---|
| Mid Iron Target No. | |
| 168 | Yellow |
| 166 | Blue |
| 164 | White |
| 162 | Red |
| Short Iron Target No. | |
| 150 | Yellow |
| 148 | Blue |
| 146 | White |
| 144 | Red |
| Putting Target No. | |
| 128 | Yellow |
| 124 | Blue |
| 126 | White |
| 118 | Red |
| 116 | Yellow |
| 114 | Blue |
| 112 | White |
| 110 | Red |

A method for using golf practice kit 100 according to the present invention will now be described with regard FIGS. 7–12.

The person using the golf practice kit 100 can choose to practice with the putting target set 102, lag putting target set 104, chipping target set 106 and/or general iron play target set 108, in any desired order. For exemplary purposes, a method according to the present invention for using the putting target set 102 will be described first.

As described above, the putting target set 102 includes first through fifth putting targets 110–118. These putting targets 110–118 can be used to practice putting on any suitable surface, such as a carpet at home, a practice green at a golf course, or a short-cut grass area resembling a golf practice green. A less skilled golfer may begin practicing with the fifth putting target 118, whose diameter is about twice the size of a regulation golf hole. However, more skilled golfers may choose to begin practicing with one of the smaller putting targets 110–116.

The methods for using the putting targets set 102 includes a distance progression and target size reduction method, a vertical target line method, and a horizontal target line method. In the distance progression and target size reduction method, a golfer should limit the maximum putting distance to about 15 feet, and begin with the fifth putting target 118 having a diameter about twice the size of a regulation golf hole.

The golfer places the fifth putting target 118 onto the supporting surface 196, such as a practice green, with the first surface 120 contacting the supporting surface 196 and the second surface 122 being exposed. The golfer then stands at a distance of about 3 feet, indicated by D1, from, for example, the center of fifth putting target 110, and attempts to putt 6 golf balls (not shown) from the distance D1 onto the first surface 120 of the fifth putting target 118.

If the golfer fails to putt six golf balls in a row from the distance D1 onto fifth putting target 118, the golfer continues to putt golf balls from the distance D1 until he or she putts onto the target 118 six times in a row. After successfully completing six putts, the golfer moves to a distance D2 from the center of fifth putting target 118, which is a distance of about six feet from the center of fifth putting target 118. The golfer then attempts to successfully putt onto the fit putting target 118 from the distance D2 six times in a row. The golfer continues putting until he or she has successfully made six putts from the distance D2.

After successfully making six putts from the distance D2, the golfer moves to a distance D3 from the center of fifth putting target 118, which is at a distance of about 9 feet. The golfer then attempts to make six putts in a row from the distance D3 onto fifth putting target 118. Once the golfer makes six putts in a row from the distance D3, the golfer moves to the distance D4, which is about 12 feet from the center of fifth putting target 118.

The golfer attempts to make six successful putts in a row from the distance D4 onto fifth putting target 118. After completing six successful putts from the distance D4, the golfer moves to a distance D5, which is about 15 feet from the center of the fifth putting target 118. The golfer then attempts to make six putts in a row from the distance D5 onto fifth putting target 118.

Naturally, although distances D1–D5 are described in 3-foot increments, any suitable distances can be selected. Furthermore, any suitable number of consecutive putts can be chosen as the practice amount.

After the golfer has successfully completed six consecutive putts from each of the distances D1 through D5, the fifth putting target 118 is left in place. The fourth putting target 116 is then placed in front of fifth putting target 118 along imaginary line 198. Specifically, the fourth putting target 116 is placed such that its center lies in or proximate to a plane passing through distance D1. Therefore, the center of the fourth putting target 116 is about three feet from the center fifth putting target 118.

The golfer then practices putting from distances D2–D5 to fourth putting target 116. That is, the golfer first attempts to successfully make six consecutive putts from distance D2 onto fourth putting target 116. Since the distance between distances D2 and D1 is about 3 feet, the golfer is attempting to make six consecutive 3-foot putts onto fourth putting target 116.

After making six consecutive putts from distance D2, the golfer then attempts to make six consecutive putts from distances D3, D4, and D5 in a manner similar to that described above. That is, golfer attempts to make six consecutive putts from distance D3 onto to fourth putting target 116. After doing so, golfer begins putting from distance D4 until he or she makes six consecutive putts onto fourth putting target 116. Finally, golfer begins putting at distance D5 until he or she makes six consecutive putts onto fourth putting target 116.

Accordingly, after completing putting from distances D2 through D5, the golfer will have practiced 3-foot putts from distance D2, 6-foot putts from distance D3, 9-foot putts from distance D4, and 12-foot putts from distance D5. In this example, the maximum putting distance onto fourth putting target 116 is 12 feet (the distance between D1 and D5).

The golfer then places third putting target 114 along imaginary line 198 in front of fourth putting target 116. Specifically, golfer places the center of third putting target 114 to lie along or proximate to a plane passing through D2. Hence the center of third putting target 114 about three feet from the center of fourth putting target 116, and about six feet from the center of fifth putting target 118.

The golfer then practices putting from distances D3, D4 and D5 in a manner similar to that described above. That is, the golfer begins putting at distance D3 to third putting target 114 until he or she makes six consecutive putts. The golfer then begins putting from distance D4 toward third putting target 114 until he or she makes six consecutive putts. Finally, the golfer begins putting at distance D5 for third putting target 114 until the golfer makes six consecutive putts. Accordingly, the golfer has practiced 3-foot putts from D3, 6-foot putts from D4 and 9-foot putts from D5.

The third, fourth and fifth putting targets 114, 116, and 118 are allowed to remain as shown, and the fourth putting target 112 is placed along imaginary line 198 in front of third putting target 114. Specifically, the center of second putting target 112 is placed at or proximate to a plane passing through distance D3. Hence, the center of second putting target 112 is about 3 feet from the center of third putting target 114, about 6 feet from the center of fourth putting target 116, and about 9 feet from the center of fifth putting target 118.

The golfer then begins putting at D4 to second putting target 112 until he or she makes six consecutive successful putts. After doing so, the golfer begins putting at distance D5 to second putting target 112 until he or she makes six consecutive successful putts. Accordingly, the golfer practices 3-foot putts from the distance D4, and 6-foot putts from the distance D5.

The golfer then places first putting target 110, which is the smallest of the putting targets, along imaginary line 198 in front of second putting target 112. In particular, golfer places first putting target 110 onto the supporting service 196 such that its center is at or proximate to a plane passing through distance D4. Accordingly, center of first putting target 110 is about 3 feet from the center of second putting target 112, is about 6 feet from the center third putting target 114, is about 9 feet from the center of fourth putting target 116, and is about 12 feet from the center of fifth putting target 118. The golfer then attempts to make six consecutive putts to first putting target 110 from distance D5, which is about 3 feet from first putting target 110.

Figure 7:
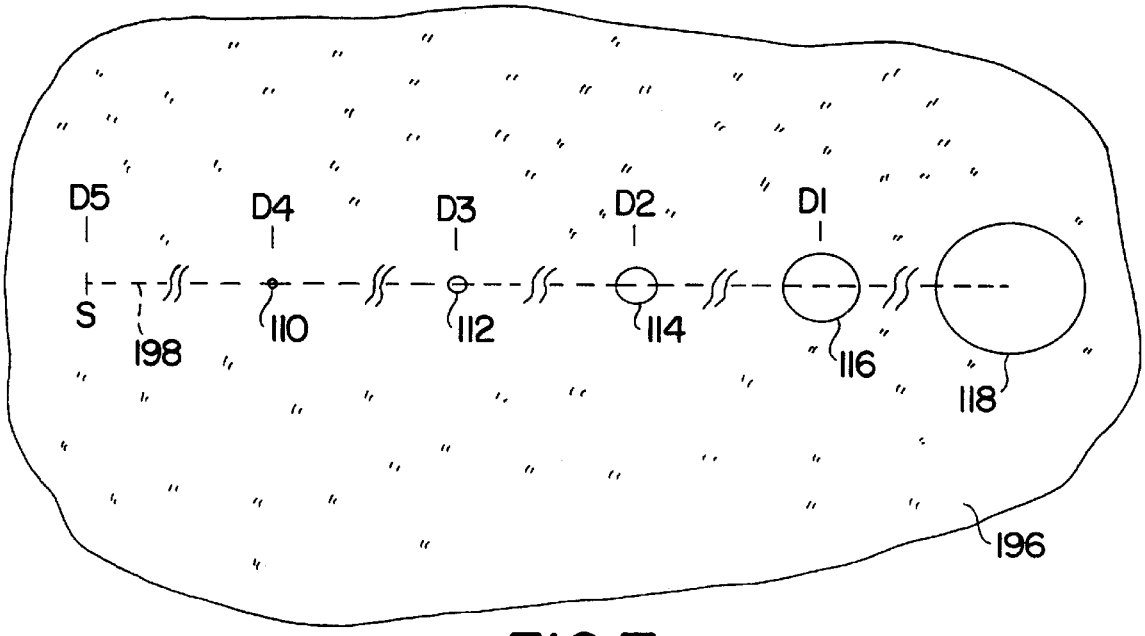
FIG. 7 is a plan view illustrating an example of plurality of targets positioned in relation to each other for performing a vertical line practice method according to an embodiment of the present invention.

Accordingly, after completing the practice putting method discussed above, the first through fourth putting targets 110–118 are arranged as shown in FIG. 7 along imaginary line 198 and with their second surfaces 122 exposed. With the putting targets 110–118 arranged in this manner, a golfer can perform the vertical target line practice method as will now be described. Also, if the golfer wishes to skip the distance progression practice method discussed above, the golfer can arrange first through fifth putting targets 110–118 in the manner shown in FIG. 7 to begin with the vertical target line practice method.

To begin the vertical target line practice method, the golfer attempts to make three successful putts from the starting point S, which is at the distance D5 along imaginary line 198, to the first putting target 110. After making three successfully putts onto the first putting target 110, golfer then attempts to make three successful putts from starting point S to second putting target 112. If the golfer misses any of those thee putts, the golfer then should start over putting at first putting target 110 from stating point S. However, if the golfer makes three consecutive successful putts onto second putting target 112, the golfer then attempts to make three consecutive successful putts from starting point S onto third putting target 114. If successful, golfer attempts to make three consecutive successful putts from starting point S onto the fourth putting target 116.

If at any time the golfer fails to make three consecutive successful putts, the golfer should start over putting at first putting target 110 from starting point S. After successfully putting to first putting target 110, second putting target 112, third putting target 114 and fourth putting target 116, golfer attempts to make three consecutive successful putts from starting point S to fifth putting target 118.

Although the method describes the golfer as attempting to make three consecutive putts, as the golfer's skills improve, the golfer can attempt to make more consecutive successful putts to each target before progressing to the next target. After completing three consecutive successful putts for each target, the golfer will have completed 15 consecutive successful putts. That is, the golfer will have completed three consecutive successful 3-foot putts onto first target 110, three consecutive successful 6-foot putts onto second putting target 112, three consecutive successful 9-foot putts onto third putting target 114, three consecutive successful 12-foot putts onto fourth putting target 116, and three consecutive successful 15-foot putts onto fifth putting target 118. As the golfer's skill improves, the targets 110–118 can be spaced further apart (e.g., 4 feet from each other, with first putting target 110 being 4 feet from starting point S).

Another way of performing the vertical target line practicing method is to make a single putt attempt to each target. That is, golfer can make one putt from starting point to first putting target 110. If successful, the golfer can attempt to make one putt from starting point to second putting target 112. If successful, golfer can attempt to make one putt from starting point to third putting target 114, and so on, until the golfer has successfully made one successful putt from starting point S to each of the five putting targets 110–118. Then golfer can attempt to make a successful putt from starting point to fifth putting target 118. If successful, golfer can make a putt from starting point to fourth putting target 116, and so on, until a final putt is made from starting point S to first putting target 110. If at any time during the practice session the golfer misses one of the targets, the golfer begins putting from starting point to first putting target 110 and repeats the process.

The horizontal target line practice method will now be described with reference to FIG. 8. In this method, the first through fifth putting targets 110–118 are placed on supporting surface 200, which is similar to supporting surface 196, along imaginary line 202, so that their centers each lie within the plane of imaginary line 202.

The golfer then attempts to successfully putt one time to each of the first through fifth putting targets 110–118 from a first distance along the line D6 which, in this example, extends parallel to imaginary line 202 at a distance of 3 feet from line 202. Accordingly, the golfer attempts to make a 3-foot putt to each of the first through fifth putting targets 110–118. If the golfer is unsuccessful in making the 3-foot putt to each of the targets 110–118, the golfer begins again putting at the largest target 118 from line D6 and continues putting at the targets in decrease in size until successfully putting all five targets.

Once the golfer has successfully putted to all five targets, the golfer repositions himself or herself to putt from line D7, which extends parallel to imaginary line 202 at a distance of about 6 feet from line 202. The golfer then attempts to make a 6-foot putt to each of the targets 110–118, beginning with the fifth putting target 118 (i.e. the largest target) first If the golfer is successful in putting to all the targets 110–118 from line D7, the golfer then repositions himself or herself at line D8 which is parallel to line 202 and about 9 feet from line 202. The golfer then attempts to putt to each of the first through fifth putting targets 110–118 as discussed previously. If the golfer is successful, the golfer attempts to putt to each of the targets 110–118 from line D9 which extends parallel to line 202 at a distance of about 12 feet from line 202. Accordingly, after putting from lines D6, D7, D8, and D9, the golfer has made 3-foot, 6-foot, 9-foot, and 12-foot putts to each of the first through fifth putting targets 110–112.

However, if the golfer fails to hit one or more targets from any of the lines D6–D9, the golfer will take three more putts at that target from that line, and should not increase to the next furthest line until he or she hits that target with two out of tree putts. For instance, if the golfer is putting from line D7 and misses the third putting target 114, the golfer will take three putts from line D7 to third putting target 114. If the golfer makes two out of three of those putts, the golfer can continue putting to the smaller targets on 112 and 110 from line D7, and then, assuming the golfer makes those putts, proceed to the next furthest line D8. However, if the golfer only hits target 114 with one out of the three putts, the golfer moves to the next closer line D6 and attempts to hit that missed target (i.e., third putting target 114) with two out of three putts from the closer line. Once the golfer is successful in hitting that target with two out three putts, the golfer returns to the further distance line at which the first missed put occurred (line D7), and again attempts to hit the missed target (target 114) and all of the remaining targets in the line with one putt before moving to the next line D8.

As with the distance progression practice method and vertical target line practice method discussed above, the distances D6–D9 need not be in 3-foot increments, but rather, can be any distances practical for the person's skill level. Furthermore, putts can be attempted at additional distances, such as 15 feet, 18 feet, or any other practical distance.

A method for using lag putting targets at 104 according to the present invention will now be described with reference to FIGS. 9–12. The lag putting target set 104 is intended to help improve golfers putting from distances of greater than 15 feet The goal of lag putting is to leave the ball in a position so near the hole that the next putt is at a "can't miss" distance, which is generally considered to be 3 feet or less.

For the lag putting method, the distances range between a minimum of 15 feet and a maximum of 45 feet. As explained above, the first, second, and third lag putting targets 124, 126 and 128 have diameters which are about 4 times, about 6 times, and about 8 times, respectively, larger than the diameter of a regulation golf hole.

The golfer's skill level generally will determine what target is suitable at a particular putting distance. Furthermore, in the lag putting method, one of the putting targets 110–118 can be used as an intermediate target which is placed half-way between the golfer and the lag putting target as shown, for example, in FIG. 9 For example, for lag putts greater than 30 feet, the fifth putting target 118 can be used. However, for lag putts less than 30 feet, the fourth putting target 116 can be used. Ideally, the lag putt should pass through the intermediate target and come to rest inside the lag putt target that was selected.

Figure 9:
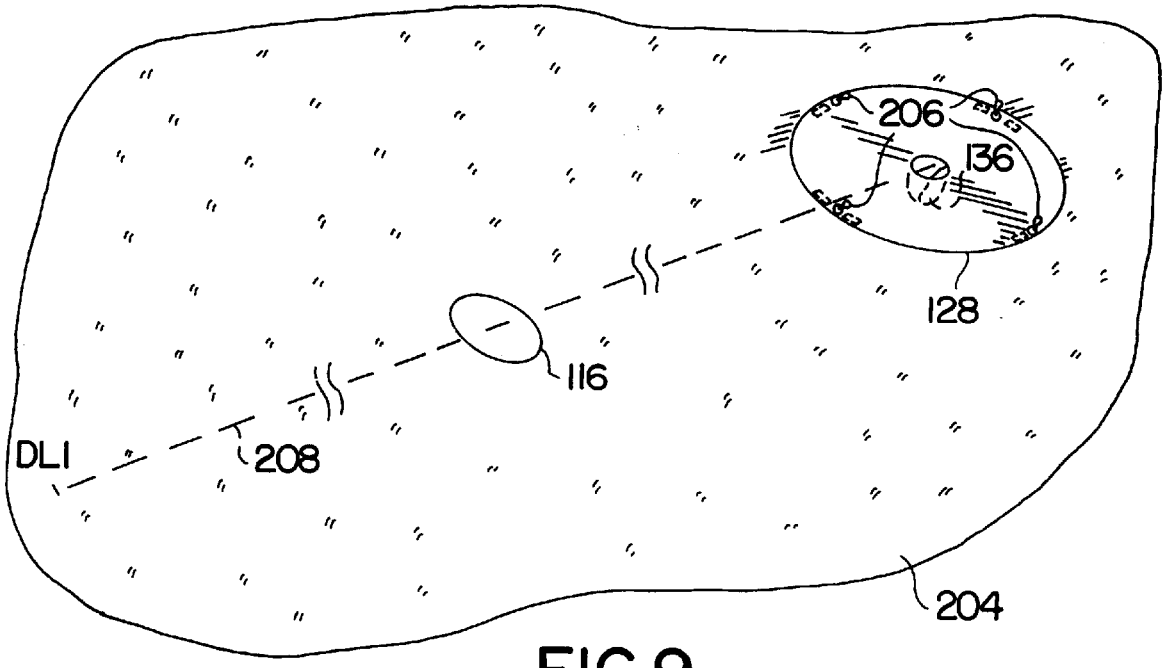
FIG. 9 is a perspective view illustrating a target included in the kit shown in FIG. 1 being used for performing a lag putting method according to an embodiment of the present invention.
Figure 10:
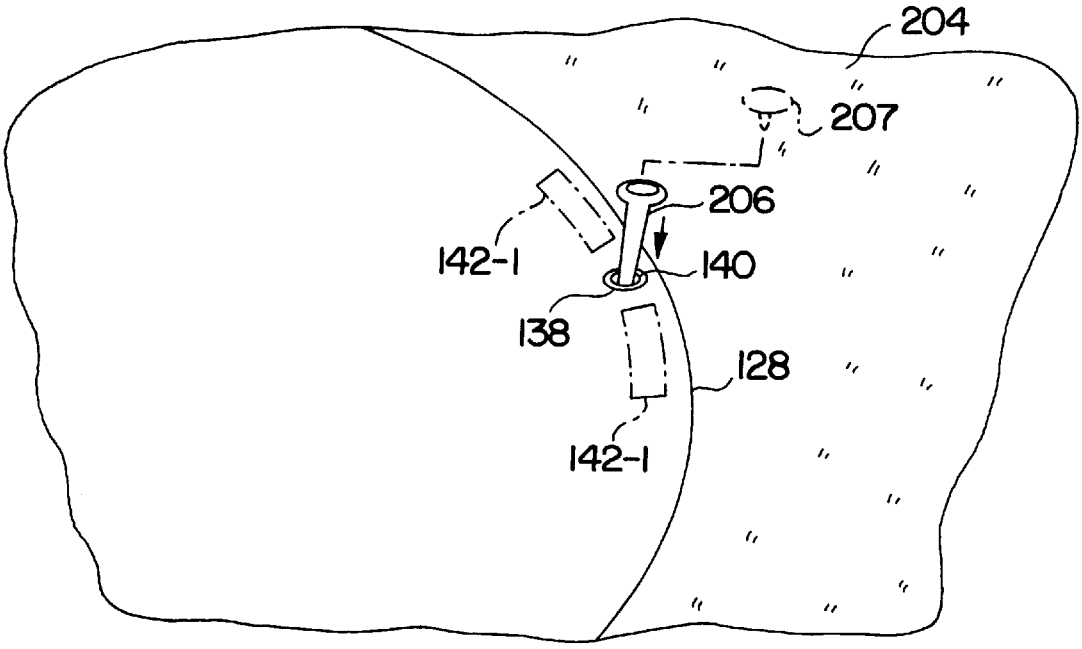
FIG. 10 is a detailed view illustrating insertion of a golf tee into an opening in the target shown in FIG. 9 to secure the target to the ground.

In the distance progression practice method for lag putting, the largest lag putt target 128 is placed at the shortest distance, which, in this example, is 15 feet. As shown in FIG. 9, a lag putt target 128 is placed with its first surface 130 on the supporting surface 204, which can be a practice green or any other suitable surface. Second surface 132 therefore remains exposed. In this example, the flap portion 136 is inserted into the golf hole on the practice green supporting surface 204. When placing the lag putt target on the supporting surface 204, as shown in FIG. 10, a golf tee 206 or ball marker 207 (shown in phantom) can be inserted through the openings 138 in the lag putt target 128 to secure the lag put target 128 to the supporting surface of 204. As discussed above, the openings 138 have a size sufficient to receive the shaft of a standard golf tee 206 without deforming or being damaged. Accordingly, the golf tees 206 help to hold the lag putting target onto the practice green supporting surface 204. Also in this example, fourth putting target 116 is used as the intermediate target and is placed about midway between the center of lag putt target 128 and putting position DL1 along imaginary line 208.

The golfer situates the ball for putting at position DL1, which in this example is the shortest lag putting distance of 15 feet. After successfully hitting a third like putting target 128 with six putts from putting position DL1, the golfer moves back from the target by 5 feet along imaginary line 208, and therefore is at a distance of 20 feet away from the target or 5 feet further away from the target than putting position DL1. The golfer than attempts to hit the lag putting target 128 with six putts in a row from this new 20-foot distance. After successfully hitting the lag putting target six times in a row from the 20-foot distant, the golfer moves back another five feet to a position 25 feet away from the lag putting target 128 and attempts to make six putts from that 25-foot distance. This continues for distances of 30, 35, 40, and 45 feet. Accordingly, when the method is complete, the golfer has successfully made six consecutive putts onto the third like putting target 128 from each of the distances of 15, 20, 25, 30, 35, 40, and 45. Each time the golfer moves back 5 feet, he or she adjusts the position of the intermediate target (e.g. fourth putting target 116), or substitutes the intermediate target with a lager intermediate target (e.g. fifth putting target 118) if appropriate.

Figure 11:
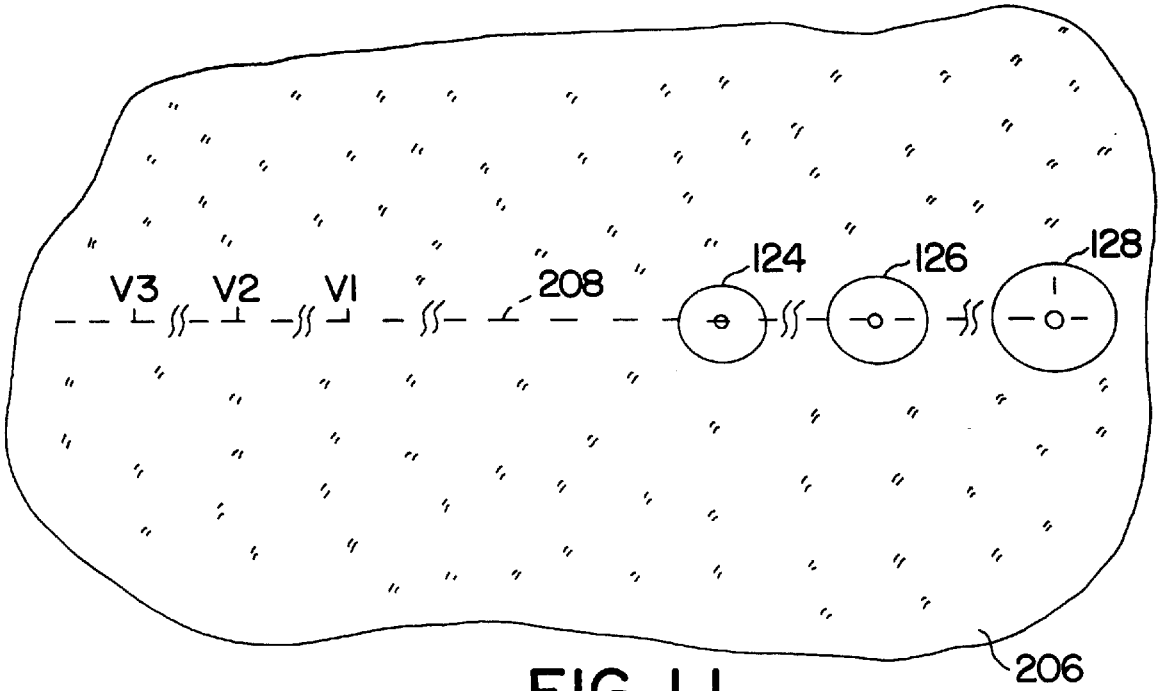
FIG. 11 is a plan view illustrating a plurality of targets, as shown in FIGS. 3 and 9, positioned in relation to each other for performing a vertical line practice method according to an embodiment of the invention.

The golfer then repeats this process for the second lag putting target 126. That is, the golfer places and secures second lag putting target 126 along imaginary line 208 shown in FIG. 9, so that the center of second lag putting target 126 lies along imaginary line 208 at about 10 feet from the center of third lag putting target 128 as shown in FIG. 11. The golfer then begins putting at second lag putting target 126 from a putting position about 10 feet behind initial position DL1. Hence, the first series of putts are from a distance of 15 feet from the center of second lag putting target 126.

The golfer continues to putt from that putting position until he or she makes six consecutive putts to second lag putting target 126. After this occurs, golfer moves back 5 feet from the putting position, which is 15 feet behind position DL1 and thus, is at a distance of 20 feet from the center of second lag putting target 126. The golfer then putts until he or she makes six consecutive putts from this 20 foot distance to second lag putting target 126. After completing six consecutive successful putts, the golfer moves back an additional 5 feet and attempts to putt six consecutive putts at second lag putting target 126 from this 25-foot distance. The golfer continues until he or she has successfully putted six consecutive putts from 25, 30, and 35 foot distances. Each time the golfer increases the putting distance, the intermediate putting target (116 or 118 ) is moved as appropriate so that it is midway between the putting position and the center of the second lag putting target 126.

This process if then repeated for first lag putting target 124. That is, first lag putting target 124 is placed on supporting surface 204 in a manner similar to that described above with regard to second and third lag putting targets 126 and 128. The center of first lag putting target 124 is placed along imaginary line 208 so that the center of first lag putting target 124 is 10 feet in front of the center of second lag putting 126, or, in other words, at 5 feet behind initial position DL1. The golfer attempts to make six putts in a row from a putting position 20 feet behind position DL1, which is 15 feet from target 124, before moving back 5 feet in a manner similar to that described above. The golfer continues until he or she has made six consecutive putts from distances of 5 feet, 15 feet, 20 feet, and 25 feet.

At the end of this method, the first, second and third lag putting targets 124, 126 and 128 are spaced along imaginary line 208 in a manner similar to that in which, for example, fifth, fourth, and third putting targets 118, 116, and 114 are spaced along line 198 in FIG. 7. That is, the center of the third lag putting target 128 is at a distance of 15 feet from putting point DL1, the center of the second lag putting target 126 is along line 208 at a distance of 5 feet from putting point DL1 and 10 feet from the center of third lag putting target 128, and the center of first lag putting target 124 is positioned along imaginary line 208 at the distance of 5 feet behind initial position DL1, and thus 10 feet from the center of second lag putting target 126.

The golfer can then perform the vertical target line practice method when the first second and third lag putting targets are in this position. This method is similar to the vertical target line practice method discussed above for the putting target set 102.

In particular, when the first, second and third lag putting targets 124–128 are positioned along imaginary line 208 as shown in FIG. 11, the golfer begins putting from putting position V1, which is at a distance of 15 feet from the center of first lag putting target 124, 25 feet from the center of second lag putting target 126, and 35 feet from the center of third lag putting target 128. The golfer can shoot three putts from position V1 to each of the first, second, and third lag putting targets 124–128, for a total of 9 putts, before increasing the putting distance. Alternatively, the golfer can putt one putt sequentially at each of the first, second, and third lag putting targets 124–128 until a total of three putts for each of the lag targets have been made, thus totaling 9 putts.

The golfer continues putting from putting position V1 until the golfer makes three putts for each of the lag putting targets 124–128, or, in other words, successfully hits each of the three lag putting targets with three putts. After making these 9 successful putts, the golfer increases to the putting distance V2, which is along imaginary line 208 at a distance of 5 feet behind putting distance V1. Accordingly the putting distance from V2 to the center of first, second, and third lag putting targets 124–128 is 20 feet, 30 feet, and 40 feet. The golfer then attempts to make three successful putts to each of the first, second, and third lag putting targets 124–128 before proceeding to third putting distance V3, which is 5 feet further away from the putting targets 124–128 then putting distance V2. After successfully putting three times to each of the lag putting targets 124–128 from putting position V3, the golfer can continue to increase putting distances in 5-foot increments, or any other suitable increments. The golfer can also use one of the smaller putting targets 110–118 as his or her skill further increases.

Figure 12:
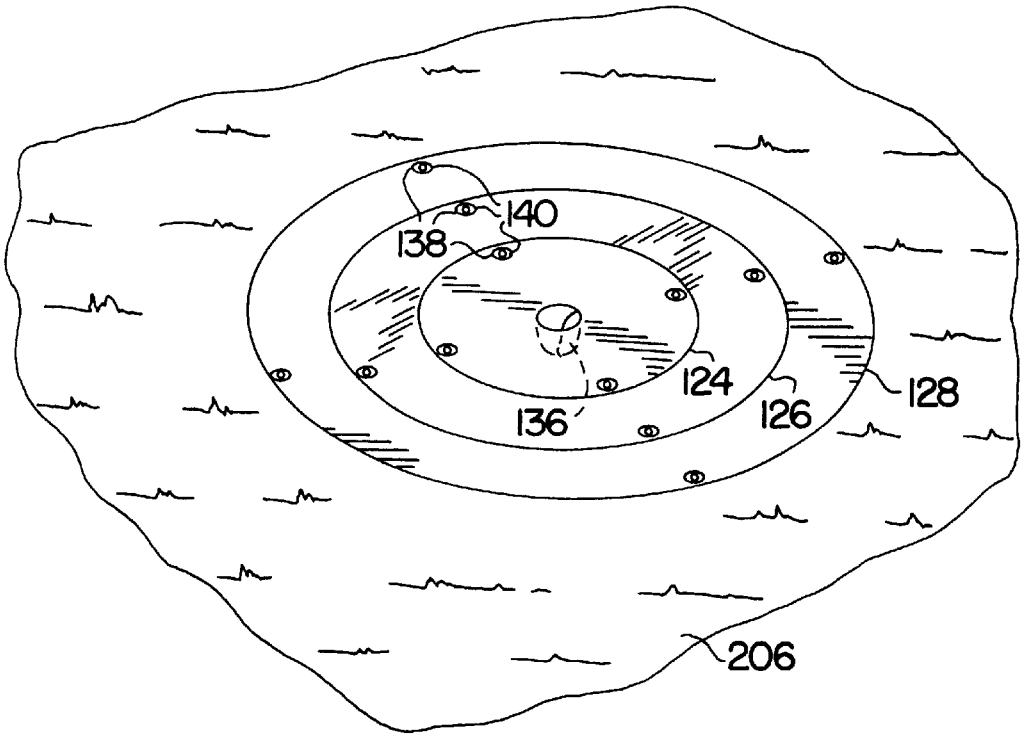
FIG. 12 is a perspective view illustrating a plurality of targets, such as those shown in FIGS. 3 and 9, stacked on each other to perform a lag putting practice method according to an embodiment of the present invention.

The three lag putting targets 124–128 can also be stacked on top of one another as shown, for example, in FIG. 12, with the third lag putting target 128 on the bottom, the second lag putting target 126 on top of third lag putting target 128, and first lag putting target 124 on top of second lag putting target 126. The flap portions 136 of each of the first through third lag putting targets 124–128 are inserted into the golf hole on the practice green supporting surface 204, for example. In this practice method, the golfer can take three putts each from distances of 15, 20, 25, and 30 feet from the center of all of the 1–3 lag putting targets 124–128, and keeps score based on where the ball comes to rest. For example, the golfer can award one point for hitting third lag putting target 128, two points for hitting second lag putting target 126, and three points for hitting first lag putting target 124. Also, the golfer can award a higher score, such as five points, if the putt is made (i.e., if the ball falls in the hole).

A method for using chipping target set 106 according to the present invention will now be described.

A chip shot typically has a lower trajectory and a longer roll than a pitch shot. The golfer can make a chip shot or a pitch shot with different clubs ranging from, for example, a five iron to a lob wedge. The golfer controls the trajectory and roll of the chip and pitch by their club selection and by the length and speed of their back swing. Golfers can reduce their inconsistency between shots by gauging the length of their back swing to their anatomy. For example, the backswing can be taken mid-thigh height, hip height, or anywhere in between. The method for using the chipping targets at 106 is intended to help a golfer control the trajectory and amount of roll a shot produces. Initially, golfers should limit their club selection to 5, 7, and 9 irons, and either in pitching or sand wedge. However, the golfers can add other clubs once they develop an understanding about the shot characteristics of each.

As with the putting targets at 102, this method includes a distance progression practice method, a horizontal line practice method, and a vertical line practice method. In the distance progression method, the golfer can position the 36-inch target (i.e. fourth chipping target 150) at a distance between 3–6 feet inside the parameter of the practice green, with its first surface 152 contacting the green and its second surface 154 exposed. Tees or ball markers, for example, can be inserted into openings 156 to secure the target 150 to the green.

The golfer then can make shots from three yards away from the edge of the practice green. For example, the golfer can hit three shots with each of the five, seven, nine and wedge clubs from the position three yards off the edge of the practice green. The golfer should attempt to hit target 150, and also should note the distance that the ball rolls after hitting the target 150. The golfer should try to produce the same swing for each of the 12 shots. After completing the 12 shots, the golfer should increase the distance from the green in 3 yard increments to 6, 9, 12, and 15 yards, repeating the 3 shots with each club from these increased yardages while noting how much the length of the ball roll increases with the longer back swing required to get the ball to hit the target 150.

Golfers can perform this method with the smaller chipping targets 148–144 as their skill increases. Also, if the golfer is very skilled, he or she can use a small target initially.

In the horizontal line practice method, the golfer places the first through fourth chipping targets 144–150 along an imaginary line which is between 3 and 6 feet into the practice green 210. The chipping targets 144–150 are thus positioned in a manner similar to that in which putting targets 118–112 are positioned along line 202 as shown in FIG. 8. Also, all the targets can be secured by a golf tee or ball marker as described above.

Using either a 5, 7, or 9 iron, or a wedge, from about six yards away from the perimeter of the green, the golfer hits one shot to each target. The golfer continues with the same club, and hits a single shot at each target from increased distances of 9, 12 and 15 yards. The golfer then repeats this process using the remaining clubs. This method therefore provides feedback to the golfer about his or her accuracy and their comfort with particular clubs, and also provides information about the length of roll each shot produces.

Figure 13:
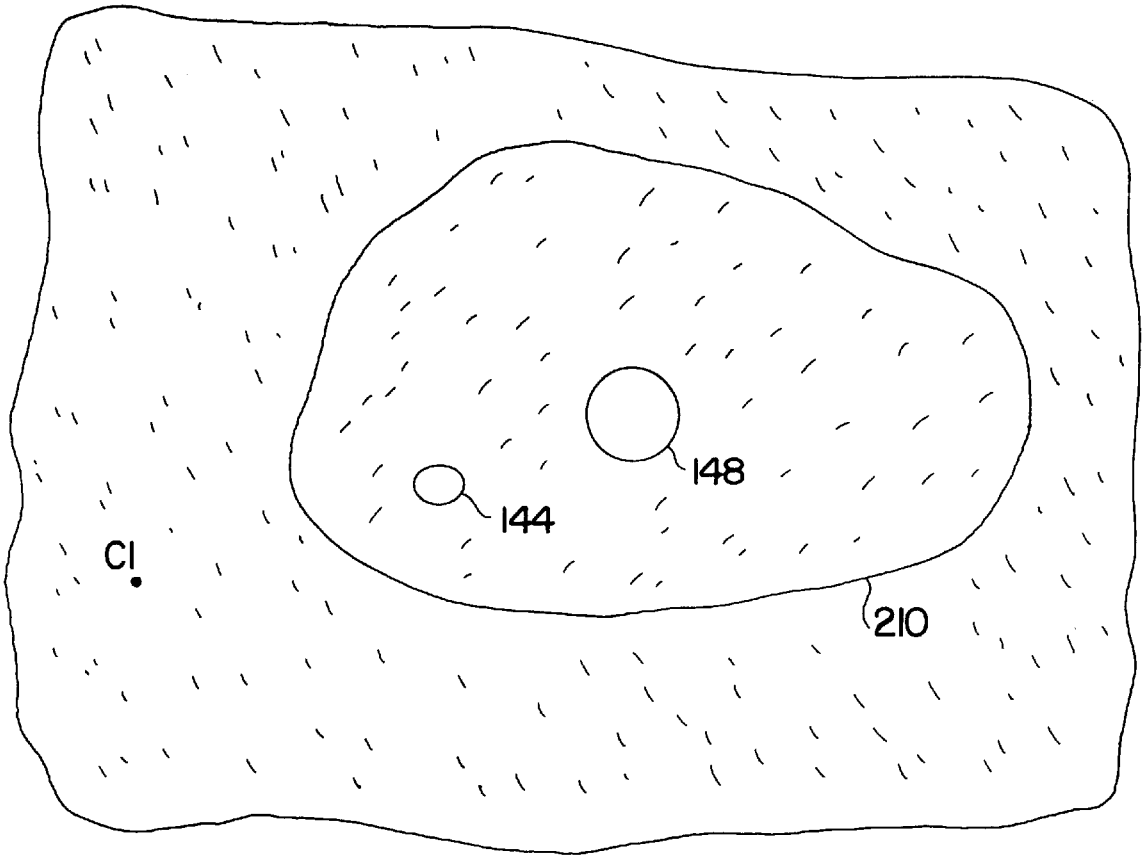
FIG. 13 is a plan view illustrating a plurality of targets, as shown in FIG. 4, positioned in relation to each other for performing a vertical line practice method according to an embodiment of the present invention.

In the vertical line practice method, golfers can measure their shot accuracy and control of the ball trajectory and length of the ball all at once. In this example, the first chipping target 144 and third chipping target 148 are used together, and the second chipping target 146 and fourth chipping target 150 are used together. As shown, for example, in FIG. 13, the golfer positions the targets (e.g., targets 144 and 148) on a practice green 210 or other suitable supporting surface. The smaller target 144 or 146 is placed between 3 and 6 feet from the edge of the green, and the second larger target 148 or 150 is placed a distance away from the small target further into the green, and acts as the final target. The golfer positions the larger target away from the smaller target based on his or her knowledge about the amount of roll that each club produces. For example, the shorter the distances between targets, the greater the loft of the club, and the greater the distance between the initial and final targets, the less loft of the club. The golfer's goal is to strike the ball from a position off the green (e.g., position C1 shown in FIG. 13) so it hits the smaller target and rolls on to the second larger target.

Golfers can create any suitable target combination to match their own skills. Initially, the golfers can use the second chipping target 146 and fourth 150 together. However, as their skill improves, they may use the first chipping target 144 and third target 148 together or can use of the smaller putting targets or lag putting targets in combination.

The chipping targets at 106 can also be used for bunker or sand trap practice. This method is similar to those described above for the target size reduction practice method, horizontal line practice method, and vertical line practice method. Instead of the golfer taking a shot from a clear area off of the green, the golfer practices his or her shots to the appropriate chipping targets out of a bunker or sand trap. The golfer's objective should be to control the trajectory and roll by displacing different amounts of sand when making their shot. The golfer controls the amount of sand displaced with his or her swing and the angle at which the club strikes the ball. For example, a long shallow swing displaces less sand, producing a lower trajectory and more roll, while a short steep swing produces a higher trajectory and less roll.

As stated above, the target size reduction method can be used for bunker or sand trap practice. The golfer can position, for example, the fourth chipping target 150 at 10 feet into the green and hit six shots at it out of the bunker or sand trap. The golfer's first goal is to hit the target and the second goal is to note the average length roll of the ball. The golfer should attempt to displace the same amount of sand with each shot. While increasing the distance in 10 foot increments to 20, 30, and 40 feet into the green, the golfer hits six shots at each distance from the sand trap, noting how they increase in roll length with the longer back swing required to get the ball to the target. The golfer can then repeat the exercise using the smaller third chipping target 148, or any other smaller target such as the second chipping target 146 or first chipping target 144.

The horizontal line method can also be used for bunker or sand trap practice. In this method, the targets 144–150 are placed along an imaginary horizontal line as discussed above for the horizontal line method. The line should be about 10 feet into the green, but could be at any suitable location. The golfer should hit one shot to each target out the sand trap, and then increase the distance of imaginary line 208 in 5-foot increments to 15 feet into the green, 20-feet into the green, and 25-feet into the green, and should hit one shot to each target while they are at the these further distances into the greens. This method provides feedback to the golfer about the accuracy he or she has developed for certain distances.

In using the vertical line method for practicing bunker or sand trap shots, golfers can use the second chipping target 146 and fourth chipping target 150, for example, in combination as described above. The golfer should attempt to have the ball end in the smaller target, and roll inside the second larger target. The targets are positioned, for example, with second chipping target 146 at 15 feet from the edge of the green, and fourth chipping target 150 at 25 feet from the first chipping target 144. The distance between the targets dictates the steepness of the swing in the amount of sand displaced. The shorter the distance between targets, the steeper the swing the golfer uses, and conversely, the greater the distance between the targets means that the golfer has a shallower swing and has displaced less sand.

As with the vertical line practice method for the chipping target set in general as described above, the golfer can use any target combination which matches his or her skills. Initially, the golfer may use the second chipping target 146 and fourth chipping target 150, but as his or her skills improve, can use the first chipping target 144 and third chipping target 148, or any of the other smaller putting targets or lag putting targets.

A method for using the general iron play targets at 108 according to an embodiment of the invention will now be described. This overall method includes a club interval progression method, a distance progression method, a vertical line method and a horizontal line method. The term "club interval progression" refers to the distance that one club can hit the ball as oppose the next club in progression. For example, if a golfer hits a ball with a pitching wedge 120 yards, and hits the ball with a 9 iron 130 yards, the "club interval" is ten yards. Men's clubs distance intervals vary between five and ten yards in general, and women's distances vary between two and seven yards in general.

In the club interval progression method, the golfer places the targets at appropriate distances to match their skills. If the club interval is 10 yards, then they place the first through eighth general iron play targets 162 through 176 on the supporting surface, such as a fairway or other suitable open space, along an imaginary line at successive distances 10 yards apart. The closest target should be at the closest distance expected by the most lofted club. For example, if the golfer typically hits a golf ball with a 9 iron 85 yards, then the closest target should be placed at 85 yards from the tee position. The targets could also be secured with a golf tee or ball marker as described above.

The golfer should determine the maximum yardage for the series of shots he or she intends to practice. The golfer positions the largest target at the maximum distance, and then begin shooting at it from the beginning yardage and continues increasing his or maximum distance from the target until the maximum yardage is reached At a minimum, six shots should be made from each distance with a particular club, before increasing the distance or attempting another club. The golfer may choose to hit few or more shots at each target at each distance, or with a particular club. Basically, the golfer should decide to use the general iron play targets 162–176 in a manner suitable to fit their needs.

To perform the club progression practice method, the golfer starts with the largest target in the set, which is eighth general iron play target 176, and places that target on the ground at the desired distance from which the golfer wishes to hit at that target. The distance of the target from the hitting line should be the maximum distance for this practice session. Generally, a golfer will become more accurate in deterring the true distance at which the target should be positioned after performing a practice session. In this example, the maximum distance can be 180 yards.

To begin the practice session, the golfer moves closer to the target 178 and attempts to hit at least 6 shots onto the target. For example, the golfer may choose to begin hitting golf balls with an 8 iron at tee position which is about 140 yards from the center of eighth general iron play target 176. The golfer hits at least 6 shots from tee position to the eighth general iron play target 176. The golfer then moves further away from the eighth general iron play target 176 along an imaginary line to a second tee position, which is, for example, 150 yards from the center of eighth general iron play target 176. The golfer then hits 6 shots at the target with the appropriate club which, for example, could be the 7 iron.

After hitting six shots at eighth general iron play target 176 from second tee position with the 7 iron, the golfer moves back along the imaginary line to a third tee position, which is about 160 yards from the center of eighth general iron play target 176. The golfer then hits 6 shots with the next size club (i.e. the 6 iron) from this third tee position. The golfer then moves back another club interval (i.e. about 10 yards) to fourth tee position, which is about 170 yards from the center of eighth general iron play target 176, and makes 6 shots with the 5 iron. Finally, the golfer moves to the maximum distance of 180 yards at a fifth tee position, and hits six shots with the 4 iron to eighth general iron play target 176.

The golfer can then repeat the above process with each of the smaller general iron play targets 174–162 until they have practiced with all or a select number of the general iron play targets.

In the distance progression practice method, the golfer starts with the eighth general iron play target 176 at a specific distance. After hitting a minimum of six shots at the eighth general iron play target 176 from the specific distance, the golfer places the seventh general iron play target 174, which is the next largest target, in front of the largest target along an imaginary line by one club length or set number of yards (e.g. 20 yards). The distance between targets will vary depending upon the golfer's skill level.

The golfer hits at least six shots from the tee position to the eighth general iron play target, and six shots from the tee position to the seventh general iron play target 174. The golfer then places the sixth general iron play target of 172 an along imaginary line in front of seventh general iron play target 174 and spaced apart from seventh general iron play target 174 by one club interval or set number of yards (e.g. 20 yards). The golfer then hits at least six shots at each of the eighth, seventh and sixth general iron play targets 176, 174 and 172, respectively, from the tee position. The golfer repeats this process for all of the remaining general iron play targets which he or she intends to use in the practice session. For example, the golfer could use all of the remaining targets 170–162, or only a select few of those targets.

At the end of the practice session, the smallest target (e.g. first general iron play target 162) will be closest and the largest target (eighth general iron play target 176) will be furthest away. At the end of his or her session, the golfer will have hit at the largest and farthest target (eighth general iron play target 176) 48 times, at the seventh general iron play target 42 times, and so on, with the minimum of six shots at the closest and smallest target.

Once the golfer knows how far he or she hits each club, the golfer can place the general iron play target at specific distances along an imaginary line in a manner similar to that shown in FIG. 7, to perform the vertical line practice method. The distances between the targets may be one or two clubs, depending upon the skill level of the golfer. The smallest target used is always closest, and the largest is always farthest away. The golfer determines the number of shots to hit at each target based upon their desire to improve their accuracy at a specific distance with a specific club. The golfer can work up and down the target line by hitting a minimum of six shots at one target before moving to the next club and distance.

Figure 8:
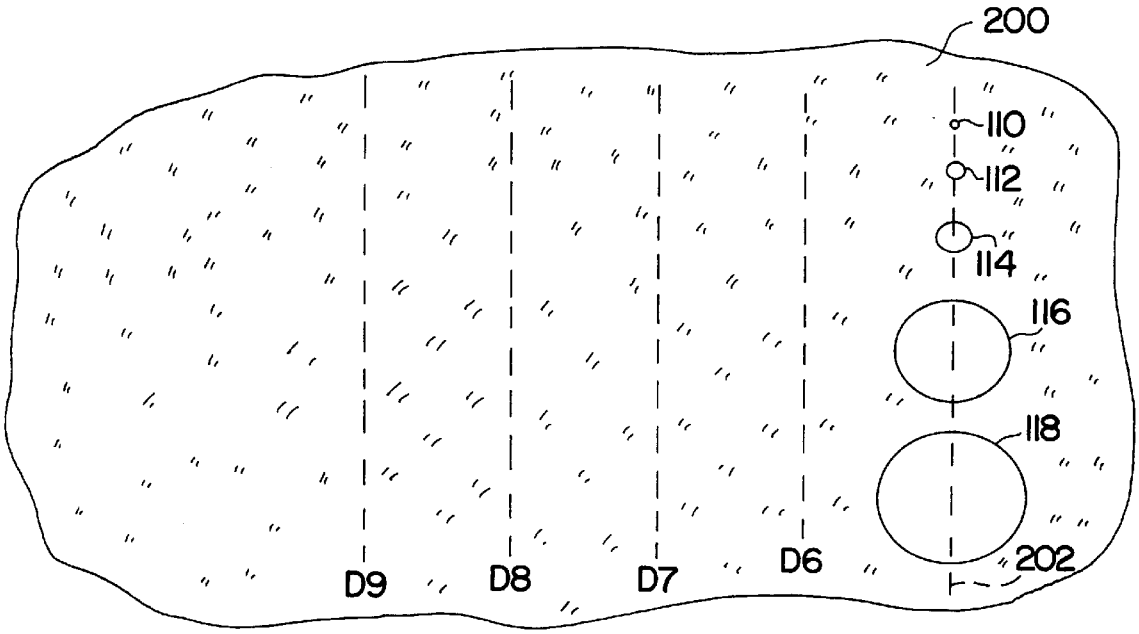
FIG. 8 is a plan view illustrating an example of a plurality of targets positioned in relation to each other for performing a horizontal line practice method according to an embodiment of the present invention.

In performing the horizontal line practice method, the golfer places all of the general iron play targets to be used during the session (e.g. all eight targets, or, for example, four targets) along an imaginary line which is at a specific distance from tee location, in a manner similar to that shown in FIG. 8. After hitting each target with two out of three shots, the golfer can increase the distance by moving away from the target line by one club interval. When the golfer fails to hit one or more targets in the line of targets, the golfer attempts three more shorts at that target, and waits to hit it with two out three shots before increasing his or her distance from the target line. If a golfer hits the target with only one shot, he or she returns to the previous distance from the target line, and attempts to hit the missed target first with two out of three shots. The golfer then attempts a single shot at each of the other targets. Once the golfer hits all the targets, he or she increases their distance by one club interval. The golfer again attempts to hit all of the targets in the line before increasing the distance away from the target line at which the shots are made.

The present invention also provide a method for scoring a round of golf which helps a golfer identify how accurately he or she is playing on any given day. The method involves subtracting the total number of fairway and green hits in regulation play from the number of putts attempted during the round. The golfer can also award points for shots that help save par, or for shots that are particularly noteworthy, such as recovered shots from under a tree, or well played chip shots, and pitch shots.

An example of a score card for performing this method is shown in the following Table 3.

TABLE 3

SAMPLE SCORING CARD

| | | | | | | | | | |
|---|---|---|---|---|---|---|---|---|---|
| Hole 1 | 2 | 3 | 4 | 5 | 6 | 7 | 8 | 9 | |
| Par 4 | 5 | 4 | 4 | 4 | 4 | 3 | 4 | 4 | 36 |
| Score 4 | 6 | 5 | 4 | 5 | 5 | 3 | 4 | 3 | 39 |
| FG2 | -G3 | F-2 | FG2 | --2 | --S2 | FG2 | F-S1 | -G1 | Total Puts 17 |
| | | | | | | F5 | G5 | S2 | Total Pts 12 |

TABLE 3-continued

SAMPLE SCORING CARD

| | |
|---|---|
| | Net Score 5 |

As demonstrated in the following example, an "F" is recorded for a tee shot that hits the fairway, and a "G" is recorded when the golf ball comes to rest on the green "in regulation", meaning that the golf ball has come to rest on the green in a few enough number of strokes which allows the golfer to take the regulation number of putts for that hole (e.g., two putts) to "sink" the golf ball in the hole and still make par for that hole. For instance, for a par three hole, the tee shot should put the golf ball on the green, thus allowing the golfer to take two putt strokes to "sink" the golf ball in the hole and still make par for the hole. For a par four hole, the second stoke (i.e., the stroke immediately after the tee shot—typically a "fairway shot") should put the golf ball on the green, thus allowing the golfer to take two putt strokes to "sink" the golf ball and still make par for the hole. For a par five hole, the third stroke should put the golf ball on the green, thus allowing the golfer to take two putt strokes to "sink" the golf ball and still make par for the hole.

As further demonstrated in the following example, a "-" is recorded in place of an "F" when the tee shot misses the fairway, and a "-" is recorded is place of a "G" when the golf ball does not reach the green "in regulation" as discussed above. An "S" is awarded for a particular noteworthy shot, such as a shot that saves par, a shot from off the fairway (e.g. from the rough) that lands the golf ball on the green, or a shot that results in a "birdie" (one below par), an "eagle"(two below par) or a "double eagle"(three below par) for that hole. Also, the actual number of putts taken from locations on the green are recorded for each hole.

The following example assumes that a 9 hole round has 1 par 5, 7 par 4, 1 par 3 and requires 18 putts (i.e., two "regulation" puts for each hole). There are eight fairways and 9 greens to hit regulation. The par 3 counts as a fairway (F) and a green in regulation (G) if the tee shot lands on the green. Therefore, the total number of shots available for fairways and greens hit in this example is 18. A perfect round yields a net score of zero, which constitutes 18 putts minus 18 fairways and greens hit in playing. The closer that a golfer's net score is to zero, the more accurately that golfer has played. If the golfer score is a negative number, the golfer has played an excellent round of golf and should have a sub-par score.

In this example, the golfer hit the fairway (F), the green (G), and took two putts (2) on the first hole. On the number 2 hole, the golfer missed the fairway, hit the green and took three putts. On a number 3 hole, the golfer hit the fairway, missed the green, put the third shot on the green, and two-putted. The golfer played hole 4 in regulation, but missed both the fairway and green on hole 5.

The golfer also missed the fairway and green on hole 6, but managed to hit a good shot from a bad lie and with a restricted swing, so was awarded an (S) for that shot, and then took two putts to sink the ball in the hole. For hole 7, which is a par 3, the golfer hit the green in regulation for two points, and took two putts to complete the hole. The golfer missed the green in hole 8, but played a chip shot close to the hole to save par and was awarded an (S) for that shot. Finally, the golfer finished with a birdie on hole 9, which made the golfers score a total of 39.

When the value of "1" is assigned for each "F", "G" and "S", total count of F's, G's and S's is 12. The total number of putts taken is 17. Hence, this scoring method resulted in a net score of 5 as indicated for this round, which equals the number of putts (17) minus the total count of F's, G's and S's (12).

This scoring method can be used from time to time during regulation or practice rounds of golf after practicing with the golf practice kit 100 so that a golfer can determine whether his or her skills are improving.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A kit for use in practicing golf, comprising:

a plurality of targets, each comprising a first substantially planar surface having a first surface area, and being adapted to rest on a supporting surface, and a second substantially planar surface, opposite and substantially parallel to said first surface, and having a second surface area, said second surface area being sufficient to enable said second substantially planar surface to carry at least a portion of a golf ball thereon when said first substantially planar surface rests on said supporting surface, and each of said targets has a respective thickness which is adapted to enable said golf ball to roll from said supporting surface onto said second substantially planar surface substantially without altering the movement of said golf ball; and said second surface area of at least one of said targets having a size different from that of said second surface area of another of said targets; and wherein one of said targets includes at least one fastening member disposed proximate to a perimeter of said one target, said fastening member including a drawstring, disposed at least partially inside said one target and being adapted to selectable maintain said one target in a folded condition.

2. A kit as claimed in claim 1, wherein:

at least one of said targets is made of a material adapted to substantially conform to said supporting surface when said first surface area rests on said supporting surface.

3. A kit as claimed in claim 1, wherein:

said second surface area of each of said targets has a size different from that of said second surface area of any other of said targets.

4. A kit as claimed in claim 1, wherein:

each of said targets are substantially circular.

5. A kit as claimed in claim 1, wherein:

at least one of said targets includes at least one opening therein, having a size sufficient to receive therethrough a shaft of a golf tee or a shaft of a golf ball marker without deforming said at least one target.

6. A kit as claimed in claim 5, wherein:

a plurality of said targets includes a respective said at least one opening therein.

7. A kit as claimed in claim 1, wherein:

said first and second surface areas of said one target each have a size sufficient such that said one target is adapted to envelop a plurality of said targets when in said folded condition.

8. A kit as claimed in claim 1, wherein:

said one target includes a plurality of said fastening members disposed at intervals along said perimeter of at least one of said first and second surfaces of said one target.

9. A kit as claimed in claim 1, wherein:

said second surfaces of said targets include a color other than green.

10. A kit as claimed in claim 1, wherein:

at least one of said targets includes a cut therein which forms a flap portion of said at least one of said targets, said flap portion being disposed substantially at a center of said at least one of said targets and being positionable at angles with respect to said first and second surfaces.

11. A kit as claimed in claim 10, wherein:

said cut is substantially C-shaped.

12. A kit as claimed in claim 10, wherein:

said flap portion has a size adapted for receipt into a hole in said supporting surface having a diameter substantially equal to a diameter of a golf hole.

13. A kit as claimed in claim 10, wherein:

a plurality of said targets include a said flap portion.

14. A kit as claimed in claim 1, wherein said plurality of targets are non-integral with each other.

15. A kit for use in practicing golf, comprising:

a plurality of targets, each comprising a first substantially planar surface having a first surface area, and being adapted to rest on a supporting surface, and a second substantially planar surface, opposite and substantially parallel to said first surface, and having a second surface area, said second surface area being sufficient to enable said second substantially planar surface to carry at least a portion of a golf ball thereon when said first substantially planar surface rests on said supporting surface, and said second surface area of at least one of said targets having a size different from that of said second surface area of another of said targets;

wherein:

one of said targets includes at least one fastening member disposed proximate to a perimeter of said one target on at least one of its first and second surfaces, said fastening member including a drawstring, disposed at least partially inside said one target, and adapted to selectably maintain said one target in a folded condition.

16. A kit for use in practicing golf, comprising:

a plurality of targets, each comprising a first substantially planar surface having a first surface area, and being adapted to rest on a supporting surface, and a second substantially planar surface, opposite and substantially parallel to said first surface, and having a second surface area, said second surface area being sufficient to enable said second substantially planar surface to carry at least a portion of a golf ball thereon when said first substantially planar surface rests on said supporting surface, said second surface area of at least one of said targets having a size different from that of said second surface area of another of said targets;

wherein:

at least one of said targets includes a cut therein which forms a flap portion of said at least one of said targets, said flap portion being disposed substantially at a center of said at least one of said targets and being positionable at angles with respect to said first and second surfaces.

17. A kit as claimed in claim 16, wherein:

said cut is substantially C-shaped.

18. A kit as claimed in claim 16, wherein:

said flap portion has a size adapted for receipt into a hole in said supporting surface having a diameter substantially equal to a diameter of a golf hole.

19. A kit as claimed in claim 16, wherein:

a plurality of said targets include a said flap portion.

20. A kit as claimed in claim 1, wherein:

said respective thickness is adapted to enable said golf ball to roll from said supporting surface onto said second substantially planar surface substantially without altering a direction of movement of said golf ball.

21. A kit as claimed in claim 1, wherein:

said respective thickness is adapted to enable said golf ball to roll from said supporting surface onto said second substantially planar surface substantially without altering a velocity of movement of said golf ball.

22. A kit as claimed in claim 1, wherein:

said respective thickness of each said of said targets is substantially uniform.

23. A kit as claimed in claim 1, wherein:

each of said targets has a said respective thickness which is adapted to enable said golf ball to roll in any direction from said supporting surface onto said second substantially planar surface substantially without altering the movement of said golf ball.

24. A kit for use in practicing golf, comprising:

a plurality of targets, each comprising a first substantially planar surface having a first surface area, and being adapted to rest on a supporting surface, and a second substantially planar surface, opposite and substantially parallel to said first surface, and having a second surface area, said second surface area being sufficient to enable said second substantially planar surface to carry at least a portion of a golf ball thereon when said first substantially planar surface rests on said supporting surface, and each of said targets has a respective thickness which is adapted to enable said golf ball to roll from said supporting surface onto said second substantially planar surface substantially without altering the movement of said golf ball; and said second surface area of at least one of said targets having a size different from that of said second surface area of another of said targets; and wherein at least one of said targets includes a cut therein which forms a flap portion of said at least one of said targets, said flap portion being disposed substantially at a center of said at least one of said targets and being positionable at angles with respect to said first and second surfaces.

25. A kit as claimed in claim 24, wherein:

at least one of said targets is made of a material adapted to substantially conform to said supporting surface when said first surface area rests on said supporting surface.

26. A kit as claimed in claim 24, wherein:

said second surface area of each of said targets has a size different from that of said second surface area of any other of said targets.

27. A kit as claimed in claim 24, wherein:

each of said targets are substantially circular.

28. A kit as claimed in claim 24, wherein:

at least one of said targets includes at least one opening therein, having a size sufficient to receive therethrough a shaft of a golf tee or a shaft of a golf ball marker without deforming said at least one target.

29. A kit as claimed in claim 28, wherein:

a plurality of said targets includes a respective said at least one opening therein.

30. A kit as claimed in claim 24, wherein:

one of said targets includes at least one fastening member disposed proximate to a perimeter of said one target on at least one of its first and second surfaces, said fastening member being adapted to selectably maintain said one target in a folded condition.

31. A kit as claimed in claim 30, wherein:

said first and second surface areas of said one target each have a size sufficient such that said one target is adapted to envelop a plurality of said targets when in said folded condition.

32. A kit as claimed in claim 30, wherein:

said fastening member is a drawstring, disposed at least partially inside said one target.

33. A kit as claimed in claim 30, wherein:

said one target includes a plurality of said fastening members disposed at intervals along said perimeter of at least one of said first and second surfaces of said one target.

34. A kit as claimed in claim 24, wherein:

said second surfaces of said targets include a color other than green.

35. A kit as claimed in claim 24, wherein:

said cut is substantially C-shaped.

36. A kit as claimed in claim 24, wherein:

said flap portion has a size adapted for receipt into a hole in said supporting surface having a diameter substantially equal to a diameter of a golf hole.

37. A kit as claimed in claim 24, wherein:

a plurality of said targets include a said flap portion.

38. A kit as claimed in claim 24, wherein said plurality of targets are non-integral with each other.

39. A kit as claimed in claim 24, wherein:

said respective thickness is adapted to enable said golf ball to roll from said supporting surface onto said second substantially planar surface substantially without altering a direction of movement of said golf ball.

40. A kit as claimed in claim 24, wherein:

said respective thickness is adapted to enable said golf ball to roll from said supporting surface onto said second substantially planar surface substantially without altering a velocity of movement of said golf ball.

41. A kit as claimed in claim 24, wherein:

said respective thickness of each said of said targets is substantially uniform.

42. A kit as claimed in claim 24, wherein:

each of said targets has a said respective thickness which is adapted to enable said golf ball to roll in any direction from said supporting surface onto said second substantially planar surface substantially without altering the movement of said golf ball.

* * * * *